US005935751A

United States Patent [19]

Matsuoka et al.

[11] Patent Number: 5,935,751

[45] Date of Patent: Aug. 10, 1999

[54] TONER FOR DEVELOPING ELECTROSTATIC LATENT IMAGE, PROCESS FOR MANUFACTURING THE SAME, DEVELOPER FOR ELECTROSTATIC LATENT IMAGE, AND IMAGE-FORMING METHOD

[75] Inventors: Hirotaka Matsuoka; Hiroyuki Tanaka; Jong Won Lee; Isamu Suzuki, all of Minami-ashigara, Japan

[73] Assignee: Fuji Xerox Co., Ltd., Tokyo, Japan

[21] Appl. No.: 08/882,104

[22] Filed: Jun. 25, 1997

[30] Foreign Application Priority Data

| | | | |
|---|---|---|---|
| Jun. 27, 1996 | [JP] | Japan | 8-167143 |
| Nov. 20, 1996 | [JP] | Japan | 8-309547 |
| Jun. 3, 1997 | [JP] | Japan | 9-145630 |

[51] Int. Cl.[6] ..... G03G 9/097

[52] U.S. Cl. ..... 430/110; 430/111; 430/126; 430/137

[58] Field of Search ..... 430/106, 110, 430/137, 126

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 5,219,697 | 6/1993 | Mori et al. | 430/110 |
| 5,368,972 | 11/1994 | Yamashita et al. | 430/137 |
| 5,635,325 | 6/1997 | Inaba et al. | 430/110 |

FOREIGN PATENT DOCUMENTS

| | | |
|---|---|---|
| B 36-10231 | 7/1936 | Japan . |
| B 42-23910 | 11/1942 | Japan . |
| A 52-3304 | 1/1977 | Japan . |
| A 52-3305 | 1/1978 | Japan . |
| A 53-3305 | 1/1978 | Japan . |
| A 56-87051 | 7/1981 | Japan . |
| A 57-52574 | 3/1982 | Japan . |
| A 59-162562 | 9/1984 | Japan . |
| A 60-222868 | 11/1985 | Japan . |
| A 61-114247 | 5/1986 | Japan . |
| A 61-138259 | 6/1986 | Japan . |
| A 63-188158 | 8/1988 | Japan . |
| A 2-87159 | 3/1990 | Japan . |
| A 3-168649 | 7/1991 | Japan . |
| A 5-88409 | 4/1993 | Japan . |
| A 5-127422 | 5/1993 | Japan . |
| A 5-197191 | 8/1993 | Japan . |
| A 7-152202 | 6/1995 | Japan . |
| A 7-168395 | 7/1995 | Japan . |
| A 7-168396 | 7/1995 | Japan . |
| A 7-271099 | 10/1995 | Japan . |

*Primary Examiner*—John Goodrow
*Attorney, Agent, or Firm*—Oliff & Berridge, PLC

[57] ABSTRACT

Disclosed is a toner for developing an electrostatic latent image comprising a binding resin and a colorant, wherein the toner contains from 0.1% to 40% by weight of wax, the amount of wax disposed on the surface of the toner is from 1% to 10% by weight, and the number-average dispersion diameter of the wax is from 0.1 to 2 $\mu$m. The toner is produced by a process comprising a step of dissolving or dispersing each of the raw materials of the resin, colorant, and wax into an organic solvent to form an oil-phase component, and a step of granulating the oil-phase component in an aqueous solvent, or a step of granulating the oil-phase component in an aqueous solvent and a step of suspension-polymerizing the particles formed in the granulation step. It is desirable that the wax be finely dispersed beforehand and that the wax be flake-shaped. The toner for developing an electrostatic latent image has the advantages that it is not necessary to supply oil to a fixing system and that the oilless fixing capability, the powder characteristics of the toner using wax, the filming characteristics, and the high transfer capability required for forming a color image can be satisfied compatibly.

20 Claims, 5 Drawing Sheets

(A): LONGITUDINAL LENGTH (B): TRANSVERSE LENGTH (C): THICKNESS

TONER FOR DEVELOPING ELECTROSTATIC LATENT IMAGE, PROCESS FOR MANUFACTURING THE SAME, DEVELOPER FOR ELECTROSTATIC LATENT IMAGE, AND IMAGE-FORMING METHOD

BACKGROUND OF THE INVENTION

1. Field of the Invention

This invention relates to toner for developing an electrostatic latent image, a process for manufacturing the same, a two-component electrostatic latent image developer using toner, and an image-forming method using the developer, which are used in an electrophotographic process and the like.

2. Description of the Related Art

Various electrophotographic processes, as such, are known. These processes are disclosed, for example, in U.S. Pat. No. 2,297,691, Japanese Patent Application Publication (JP-B) No. 42-23910 (U.S. Pat. No. 3,666,363), and the like. The electrophotographic process generally comprises basic steps consisting of an exposure step of forming an electrostatic latent image using various measures on a photosensitive layer utilizing a photoconductive material; a step of developing using a toner; a step of transferring the toner on a recording medium, e.g., paper; a step of fixing the toner image on the recording medium by means of heating, pressure, heat and pressure, solvent vapor, or the like; and a step of removing the toner remaining on the photosensitive layer.

There have lately been increasing demands for inexpensive and compact copy machines and printers using an electrophotographic method. It is important that a toner be fixed using lower power consumption and that, at the same time, a fixing process be simplified to design such copy machines and printers.

At present, a fixing process using a heat roller is adopted as the most common process for fusing toner to fix it on paper. It is not necessary to supply oil to the heat roller in systems for monochromatic copy machines or printers. However, in machines using a color toner, it is still necessary to provide a means of supplying oil to the heat roller to prevent an offset to the heat roller. This is obstructive to the design of a compact and inexpensive system because of the reasons that follow. Specifically, it is necessary to thermally fuse each of the toner layers in a full-color system which is required to produce a sharp multicolor image using color toners, especially cyan, yellow, and magenta toners. To this end, the fixing temperature of the heat roller must therefore be increased to a temperature high enough to fix the toner on paper.

Also, as a toner for developing an electrostatic latent image used in an electrophotographic field, resins which can fuse sharply and which allow the image surface to be smooth, specifically, resins having a low molecular weight and a narrow molecular weight distribution, are convenient. A very useful resin which has been recently adopted as the toner is polyesters which have a sufficient flexibility even if these are lowered in molecular weight. When such polyester resins for a color toner have low internal cohesive force, it is difficult to release toner from a roller during fusing. Accordingly, it is difficult to adopt polyester resins as a color toner in a fixing system without application of oil.

Approaches to solve these problems are, for example, disclosed in Japanese Patent Application Laid-Open (JP-A) Nos. 52-3304, 52-3305, 57-52574, 61-138259, 56-87051, and 63-188158. In these approaches, a toner to which a releasing agent is added is used so that the toner can be peeled off from a roller with ease, and these approaches have been widely investigated. The toner into which a releasing agent is incorporated is successful in the characteristic of release from the roller to some extent. However, not all characteristics required for a toner are necessarily satisfied. One of the reasons for this phenomenon, for example, is that the amount of releasing agents contained inside the toner and the amount existing on the surface of the toner cannot easily be controlled at the optimum condition. More concretely, in order to satisfy the characteristic of release from the roller, the amount of releasing agent added to the toner is preferably in a range of from 1% to 10% by weight. As the amount of releasing agent is increased, the releasing effect is higher. However, the powder fluidity and thermal cohesiveness of a toner prepared in a kneading-pulverizing process, which is a common method for preparing a toner, are impaired by adding the releasing agent only in an amount of from 1 to 3% by weight. This is because wax usually used as a releasing agent is deposited at a high concentration together with a pigment at the toner surface, that is, a pulverized surface. Further, when the toner is processed in apparatuses such as a pulverizer and a classifier used in production stages, the wax concentrated on the surface melts partially and spreads due to the collision between particles and frictional heat generated by friction in apparatuses. The spread wax finally covers the surface of the toner. According to Japanese Patent Application Laid-Open (JP-A) No. 02-87159, impact force was mechanically applied on a toner containing wax, which had been kneaded and pulverized, to make the toner spherical and then the amount of wax on the surface of the toner was measured by ESCA. As a result, the amount of wax was found to be on the order of 10% to 40% by weight. The ratio of wax remaining on the surface of kneaded-pulverized-type toner containing 1% to 10% by weight of wax is usually in a range of from 30% to 50% by weight. This wax on the surface causes a blocking phenomenon and, also, contaminates the surfaces of a photosensitive member and carrier, thereby causing the developing characteristics to be changed. Also, there are problems in that the adhesion to a photosensitive member and to a transfer intermediate increases, resulting in a reduction in transfer efficiency and that image smear occurs when a color image requiring multiple transfer is formed.

Processes for preparing novel toners have been proposed to overcome these drawbacks of the toner to which wax is added. One of these toners is a toner having a capsule-type structure which is disclosed in Japanese Patent Application Laid-Open (JP-A) Nos. 60-222868, 61-114247, and 59-162562. Using this capsule-type toner, the proportion of components with a low molecular weight such as wax and the like disposed on the surface of the toner particles can be reduced to 0% to 1% by weight. Problems related to the above-mentioned blocking and filming characteristics and also to the developing characteristics are comparatively difficult to solve. Such a toner provided with no wax on the surface thereof often fails in providing sufficient capability for being released from a roller. In order to avoid offset to a heat roller, it is necessary to instantly form a weak boundary layer composed of melted wax and the like between a toner fused at a fixing nip of a heat roller and the surface of the heat roller and thereby to prevent direct contact with a toner resin in an extremely short period of time. However, if wax is entirely inside the toner, a delay owing to the diffusion of wax to the surface of the toner occurs so that the weak boundary layer cannot be sufficiently formed. When a color image is formed using the capsule-type toner having a hard shell on the surface, a higher temperature is usually required to melt the toner image completely. It is further difficult to release toner from a roller, especially in processes for fixing toner at high-speed.

Another method for preparing toner is one of forming a so-called "pseudo-capsule structure". Specifically, in this pseudo-capsule structure, oil droplets of a monomer composition or a toner composition are formed in a dispersing medium with high polarity such as water. Polar components contained in the oil droplets are allowed to existing in a surface layer corresponding to the boundary layer between the water-phase and the oil-phase, and nonpolar components are not allowed to exist in the surface layer. A typical example of this toner is a toner prepared in the suspension-polymerization process which is disclosed in Japanese Patent Application Publication (JP-B) No. 36-10231. For a toner produced by a wet process, the amounts of wax existing on the surface and inside the toner can be controlled in a range in which the resistance to blocking and the oilless fixing capability are comparatively compatible by making use of such characteristics of the process. However, in toner produced by the suspension-polymerization process, the phase separation of nonpolar wax components from polymers including polar monomers as a major component is promoted as polymerization progresses, resulting in the formation of the above pseudo-capsule structure. However, phase separation during the polymerization process tends to vary depending on the composition of the monomers and polymerization conditions, and hence it is difficult to practice such structural control in actual industrial application in a stable manner. Japanese Patent Application Laid-Open (JP-A) No. 05-88409 describes that wax cannot exist in the surface layer to a depth of 0.15 times the particle diameter, exhibiting the same problem as the capsule-type toner. Also, compositions of polymerizable monomers of a resin to be toner are limited to monomers capable of being solution-polymerized such as styrene and its derivatives and α-methylene aliphatic monocarboxylates. Problems occur in which it is difficult to use polyesters which are required for producing a color toner as above-mentioned because of the toner resins.

The problem of the limitation in selection of a resin material for a toner is involved in the above-described kneading-pulverizing process. Specifically, a resin for a toner must be pulverized using an usual pulverizer and hence the resin is therefore required to be fragile. In this case, the problem arises that the resin is overly pulverized in a pulverizing step, whereby the size distribution is wider and contamination with bulky particles occur.

In view of this, a novel toner structure which meets the demands for wide selectivity as a toner resin, better compatibility of an oilless fixing capability with resistance to blocking, and excellent stability in development and transfer, and a novel process for manufacturing such a novel toner are required. Further, according to Japanese Patent Application Laid-Open (JP-A) No. 5-127422, a method is disclosed in which an oil-phase solution having a toner component dissolved therein is formed into particles in a water-phase containing a water soluble resin. Also, according to Japanese Patent Application Laid-Open (JP-A) No. 7-152202, a method is disclosed in which polyester is dissolved and then formed into particles in a water-phase containing an inorganic dispersant. Further, in Japanese Patent Application Laid-Open (JP-A) Nos. 7-168395 and 7-271099, tricalcium phosphate and hydroxyapatite, which have a particle diameter of 0.7 to 5 μm, are proposed as an inorganic dispersant to be used. In these proposals, however, there are no descriptions of a releasing agent such as wax being added as a component for a toner, the amounts of wax on the surface and inside the particle are controlled in a specific range, and the compatibility of the resistance to blocking with the oilless fixing capability is maintained at a high level. When a toner was produced in practice by adding wax according to Japanese Patent Application Laid-Open (JP-A) Nos. 7-168395 and 7-271099, it was confirmed that polyester particles were prepared, but the size distribution was large, and the amount of toner micropowder of a size of 1 to 2 μm or less, which was unsuitable for toner, increased and it was difficult to remove the powder by mechanical classification. Also, there are problems that colorants used for color toner include compounds which cause an increase in the amount of toner micropowders.

Regarding important functions required for copy machines or printers, there are demands in which a clear color image is outputted on media other than paper. Among these demands, those for forming a fixed image on a transparent film to make transparencies used for explanations using an overhead projector (OHP) are important in a field for color image production. However, color toners produced by a pulverizing process and by a polymerization process include those which are insufficient in color caused by the inadequate dispersion of wax. There are color toners which provide only an insufficient transparent image, especially, for an OHP image. Particularly, in the case of using a low-molecular-weight polyester as a binding resin and a low-molecular-weight wax as a releasing agent, a toner produced by a pulverizing method exhibits the above problems more strikingly since an adequate share is not applied in the steps of melting and kneading. At present, there is no adequate means for solving the above problem of insufficient compatibility of oilless fixing capability with high transfer capability relating to manufacturing of toner, specifically, relating to the homogeneous dispersion of wax as the releasing agent into the toner resin, especially into the polyester resin which is suitably used.

SUMMARY OF THE INVENTION

A first object of the present invention is to provide, without the above-mentioned problems and disadvantages, a novel toner, which has advantages in designing compact and simple copy machines or printers, and which does not require that oil be supplied to a fixing system; a developer including the toner; and a simple process for manufacturing the toner.

A second object of the present invention is to provide a novel toner which ensures high compatibility between the oilless fixing capability and powder characteristics of the toner using wax, filming characteristics, and further high transfer characteristics required for forming a color image; a developer; and a process for manufacturing the toner.

A third object of the present invention is to provide an image-forming method using a novel toner which provides a color image of high quality and an excellent OHP transmitting image.

The present inventors have conducted extensive studies to solve the above problems and, as a result, found that the above problems and disadvantages could be solved using the toner and process below to complete the invention.

Accordingly, a toner for developing an electrostatic latent image of the present invention comprises a binding resin and a colorant, wherein the toner contains wax in an amount from 0.1% to 40% by weight, the amount of wax disposed on the surface of the toner is from 1% to 10% by weight, the number-average dispersion diameter of the wax is from 0.1 to 2 μm, and preferably particles of the wax are flake-shaped.

Also, a two-component developer for an latent image of the present invention comprises a carrier and a toner, wherein the toner contains wax in an amount from 0.1% to 40% by weight, the amount of wax disposed on the surface of the toner is from 1% to 10% by weight, and the number-average dispersion diameter of the wax is from 0.1 to 2 μm.

Further, a method of manufacturing a toner including at least a resin, a colorant, and a wax for developing an electrostatic latent image of the present invention comprising: a step of dissolving or dispersing each of the materials of the resin, colorant, and wax into an organic solvent to form an oil-phase component; and a step of granulating the oil-phase component in an aqueous solvent, wherein the number-average dispersion diameter of the wax formed by the granulating process is from 0.1 to 2 μm. The toner may be manufactured by a process in which a colorant and wax are dispersed, and thereafter the dispersion is granulated and subjected to a suspension-polymerization process.

Because the toner of the present invention involves low-melting-point wax on the surface and inside of the toner in a preferable range, it is easily released from a fixing roller and has high resistance to heat blocking. Compact and inexpensive color copy machines or printers can be designed which do not require supplying oil to a fixing system. In the process for manufacturing a toner of the present invention, wax having a low melting point, which was difficult to use in a conventional kneading-pulverizing method, can be suitably used and dispersed in a polyester resin, which is difficult to use as a binding resin in a conventional polymerization process, the wax maintaining its excellent properties. Also, the shape of the toner can be optionally controlled so that a toner can be designed having excellent powder characteristics and a high transfer efficiency. In the process for manufacturing toner, micropowdery wax is used, and the dispersion unit of wax inside the toner can be microdispersed so that toner providing a high-quality color image, particularly an excellent OHP transmitting image, can be obtained.

DESCRIPTION OF THE PREFERRED EMBODIMENTS

Figure 1:
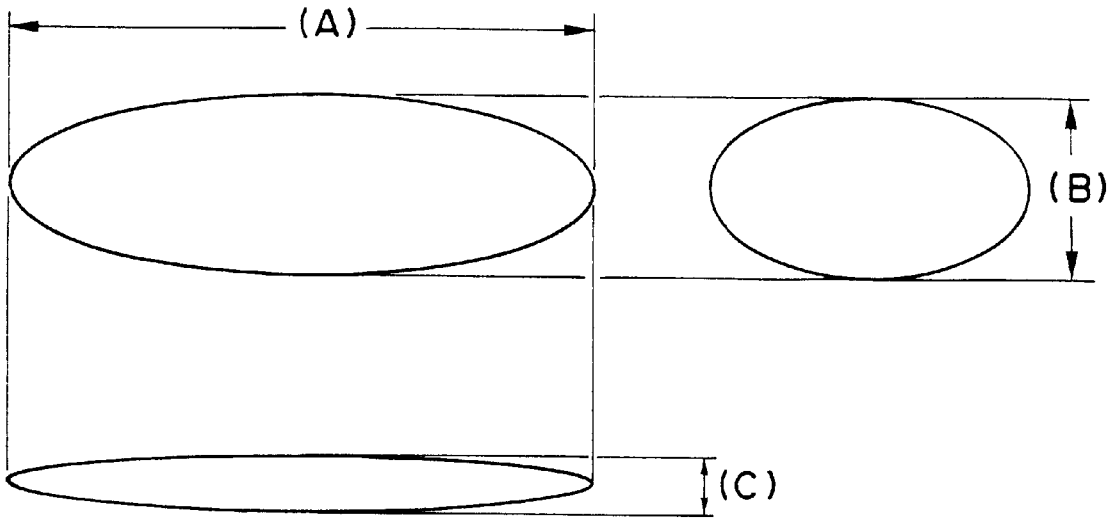
FIG. 1 is a view of a model of a wax particle, showing configurations in a longitudinal direction, a transverse direction, and a direction along the thickness of the particle of wax.

The present invention will now be explained.

First, a process for manufacturing toner for developing an electrostatic latent image (hereinafter also called "toner") and the structure of the prepared toner will be explained. A component having a polar group and a non-polar component such as wax which are contained in a toner composition are structured due to the difference in affinities of the hydrophilic property and hydrophobic property to generate oil droplets of the toner composition in a water-phase composed of an aqueous solvent. The structure of the toner in the present invention is formed based on this structuring effect. It is confirmed that the amount of wax contained in the toner is in a range of from 0.1% to 40% by weight and the ratio of wax disposed on the surface of the toner is controlled in a range of from 1% to 10% by weight due to the structural characteristics of the toner of the present invention.

The amount of wax added to toner particles is generally from 0.1% to 40% by weight and preferably 1% to 15% by weight, although it depends on the average dispersion diameter of wax which is micro-dispersed. If the amount is less than 0.1% by weight, the preferable releasability from a roller cannot be obtained, whereas if the amount exceeds 40% by weight, the toner decreases in resistance to blocking and the transmittance of an image decreases after being fixed. In addition, if the amount of wax on the surface of the toner is less than 1% by weight, the resistance to offset is insufficient, whereas if the amount of wax on the surface of the toner exceeds 10%, the developing characteristics and transfer characteristics deteriorate and the filming on a photosensitive member and on a charging member is remarkably increased, which are both undesirable.

In the present invention, the ratio of wax disposed on the surface of the toner can be measured based through elemental analysis of the surface using ESCA. Briefly describing the elemental analysis using ESCA, first, elements on the surface of toner are measured to determine the elemental composite ratio of the surface. Then, the molecular formulas of compounds contained inside the toner are determined and the amount of each compound existing on the surface is calculated from the elemental composite ratio measured by ESCA. The measuring conditions for analysis in ESCA used in the present invention are as follows:

Measuring apparatus: X-ray photoelectron spectrometer Esca-Lab-220I, manufactured by VG Corporation;

Measuring conditions: X-ray source Mg (300 W), Pass energy=30 eV, sampling=0.1 eV step, dwell time=100 ms.

Describing the sequence for quantitative calculation, first, the carbon=C 1s spectrum of the toner was separated for each component using a curve fitted using the least squares method. For the components used for the fitting, the C Is spectrum obtained by independent measurement for each component which constitutes the toner was used. In this case, for processing fitting, an original program developed by the present inventors was used. The amount of each compound existing on the surface of the toner was calculated from the atomic concentration calculated in the above manner. Regarding the calculation method, the ratio constituting each compound was calculated by using the atomic concentration. That is, the ratio of each element of each compound was determined independently; thereafter, the existing number ratio of each compound was calculated from the ratio of each element existing on the surface of the toner. Next, the ratio by weight of each compound was calculated by multiplying the molecular weight of each compound by the existing number ratio. From these calculations, the ratio of wax existing on the surface was determined quantitatively. Here, the surface in the present invention was defined as the surface layer ranging to a depth of 0.1 μm from the outermost surface of the toner. The above-mentioned ratio of each compound on the surface, which was measured using ESCA can be measured up to a surface depth of several nm to 0.5 μm The ratio of wax existing on the surface of a toner produced by a common kneading-pulverising process is from 10% to 50% by weight, even though this varies slightly depending on the absolute amount of wax to be contained.

As wax used for the toner of the present invention, low-melting-point wax having a melting point of 110° C. or less and a latent heat of melting of 230 mJ/mg or less is used. It was confirmed that such wax operated effectively as a releasing agent at a boundary between a fixing roller and toner, thereby preventing high-temperature offset without applying a releasing agent such as oil to the fixing roller.

If the melting point is 100° C. or higher or the latent heat of melting of 230 mJ/mg or more, the releasability is insufficient. Also, if the melting point is 30° C. or lower, a case may occur in which the resistance to blocking and storability of the toner deteriorate, which is undesirable. The melting point of wax in this invention is defined as a temperature corresponding to the maximum endothermic peak measured using a differential scanning calorimeter (DSC).

The materials that follow can be used as wax components which function as the releasing agent used in the present invention: Typical examples of the wax components include, as waxes, plant waxes such as carnauba wax, cotton wax, haza wax, rice wax, and the like; animal waxes such as beeswax, lanolin, and the like; mineral waxes such as ozokerite, selsyn, and the like; and petroleum waxes such as paraffin, microcrystalline wax, petrolatum, and the like. Also, other than these natural waxes, synthetic hydrocarbon waxes such as Fisher/Tropsch wax, polyethylene wax, and the like; and synthetic waxes such as esters, ketones, ethers, and the like can be used. Further, crystalline polymer resins having a branched long chain alkyl group including fatty acid amides such as 12-hydroxystearic acid amide, stearic acid amide, phthalic imide anhydride, chlorinated hydrocarbon, and the like; and homopolymers of polyacrylate such as poly-n-stearyl methacrylate, poly-n-lauryl methacrylate, and the like which are a low-molecular-weight crystalline polymer and copolymers of these compounds (for example, n-stearyl acrylate-ethyl methacrylate) can be used. Among these, petroleum waxes including paraffin wax, microcrystalline wax, and the like, and synthetic waxes are preferable.

With respect to the problem that the transmittance of the image decreases slightly after fixing when a transparency film was used as a recording (image receiving) medium, it was confirmed that the problem depended on the dispersion unit of wax contained in the toner. That is, if the dispersion unit of wax inside the toner is designed such that the particle diameter has little influence on transmittance, the problem of transmittance can be eliminated regardless of the degree of crystallinity. The average particle diameter (here, indicated as "number-average particle diameter") of the wax dispersed in the toner is from 0.1 μm to 2 μm, and preferably from 0.1 μm to 1 μm. It is necessary that wax used at the step of producing a toner be dispersed finely in advance to 2 μm or less, and preferably to 1 μm or less. If the average diameter of wax dispersed in the toner exceeds 2 μm, the transmittance of the image after fixing decreases when a transparency film is used. Also, if the average diameter of wax is less than 0.1 μm, the releasability is insufficient.

The average diameter of wax can be determined by the method that follows. A toner is solidified using a binding resin such as an epoxy resin and the solidified toner is sliced using a microtome to form a sliced toner with a thickness of about 1,000 Å, which is then subjected to a transmitting light microscope to observe phase-separated wax particles. In the present invention, 10 points were measured and the average of 5 points with the larger value among the measured 10 points was defined as an average particle diameter to minimize error due to the differences in slice locations.

Wax may be finely dispersed by any conventional or known process using an emulsifying or dispersing apparatus, for example, such as that described in Chemical Reaction Engineering Report 1 (Emulsifying Dispersing Technology and Particle Diameter Control of Polymer Microparticle, Chapter 3) March 1995, published by Polymer Association. In addition, processes other than the above for dispersing wax include a process in which wax is added to an appropriate solvent which is mutually soluble with the solvent used in the step of preparing a toner and in which wax does not dissolve at room temperature, and the wax is melted by heating, followed by gradual cooling to room temperature to precipitate micro-particles of the wax (melting-precipitation process). Also, a process may be used in which wax is vaporized by heating in an inert gas such as helium to prepare particles in a vapor phase, the prepared particles are allowed to adhere to a cooled film and thereby to recover wax particles which are then dispersed into a solvent (vapor-phase evaporation process). If these processes are combined with the above mechanical pulverizing process using an emulsifying and dispersing apparatus, it is effective because of the reasons below. That is, it is necessary to apply a high shearing force to attain a desirably finely dispersed particle diameter only by the mechanical pulverizing process. The increase of temperature due to the high shearing force may bring about an unacceptable influence on wax with a low melting point.

In the present invention, the finely dispersed wax particles preferably are a flake-shaped. The flake shape is defined as a configuration in which the maximum longitudinal length is 2 or more times the thickness and the maximum the transverse length is 1.5 or more times the thickness. The method for determining the longitudinal direction, the transverse direction, and the direction of the thickness of wax in the present invention is shown with reference to the view of a model of wax particle in FIG. 1. The longitudinal direction of the wax particle is indicated by the line A in FIG. 1, which is the direction of the maximum diagonal length of the wax particle. The direction of the thickness is indicated by line C in FIG. 1, which shows the direction of the shortest length in the maximum width shown in the projection drawing viewed from the direction perpendicular to the maximum diagonal length line (A). The direction perpendicular both to the longitudinal direction and to the direction of thickness is defined as the transverse direction, which is indicated by line B in FIG. 1. Wax particles that are flake-shaped as defined in the above manner, specifically defined as the configuration in which the maximum longitudinal length is 2 times or more the thickness and the maximum transverse length is 1.5 times or more the thickness, are preferably contained in a proportion of 75% or more by number to the total number of wax particles. In a case where such flake-shaped wax particles are used, the thickness is 0.5 μm or less and preferably 0.2 μm or less.

Because wax particles are flake-shaped, the wax is melted promptly and wax contained inside the toner is melted more rapidly, compared to spherical wax particles. Also, since flake-shaped wax particles have an elongated shape in a longitudinal direction, the amount of wax existing in the vicinity of the surface of the toner increases so that there is a tendency for the offset capability of the wax to be exhibited efficiently.

It is preferable that such flake- shaped wax particles also be fine. It is also preferable that the number of particles with a maximum diameter of 5 μm or more be preferably 10% or less to the total number of particles and that the number-average of the maximum longitudinal length be 1 μm or less. If the size of wax particles is larger, light transmittance may be decreased more due to the scattering of light. Also, there is the tendency that the light transmittance of an OHP film is impaired and color generation is reduced.

Wax particles are dispersed in an organic solvent together with a resin and a colorant prior to the preparation of an oil-phase. It is desirable that the wax dispersion be prepared by applying pressure to a solution prepared by mixing the wax with a solvent to make a high-pressure condition and by ejecting the solution from a clearance such a nozzle to hit the solution against a vessel wall or the like and thereby micro-dispersing the wax in the solvent.

Figure 2A:
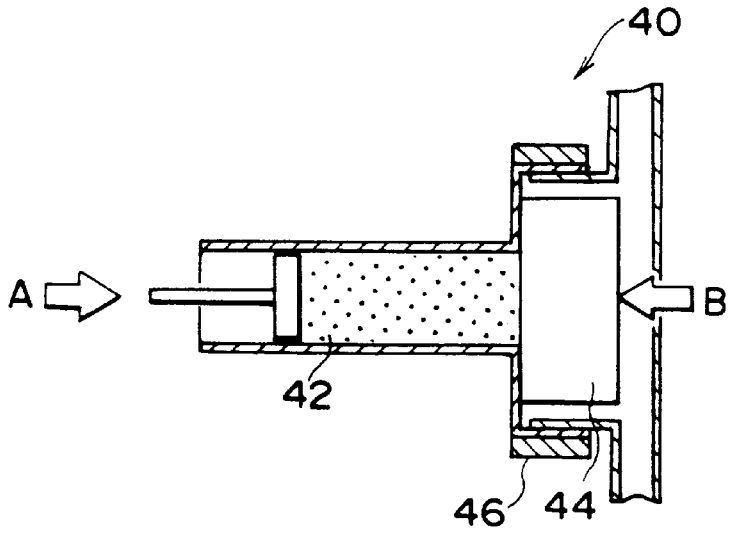
FIGS. 2A and 2B are schematic sectional views showing wax micro-dispersing apparatus in which clearances are formed when pressure is applied exceeding a fixed pressure to eject a mixture from the clearances.
Figure 2B:
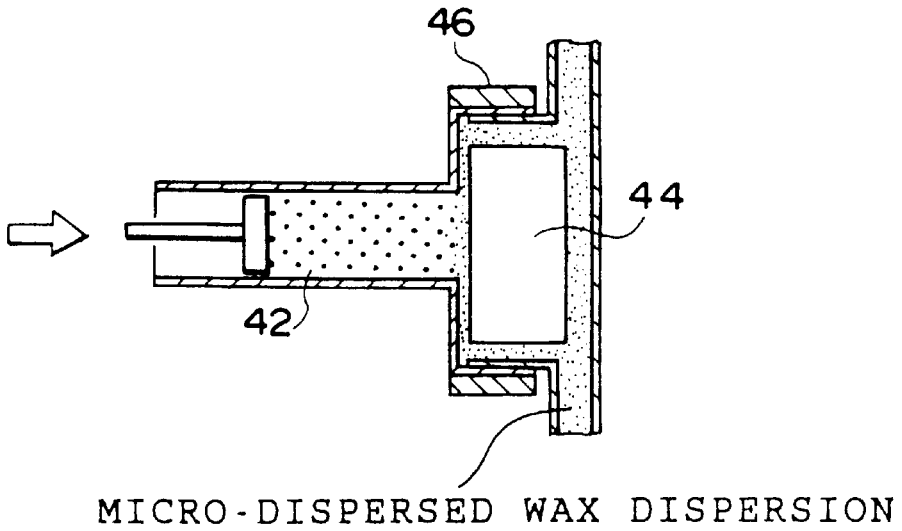
Figure 3A:
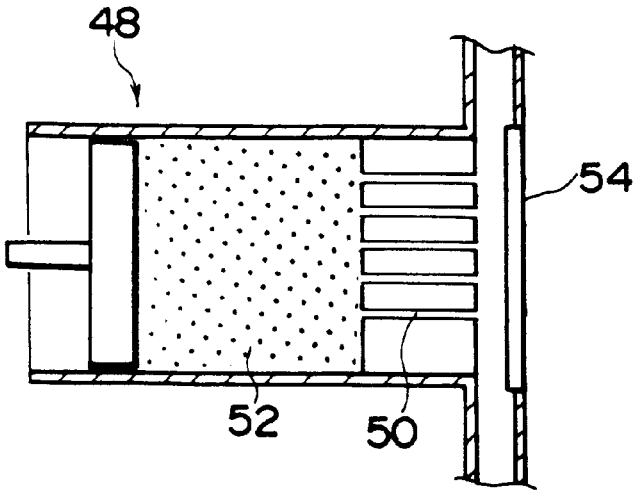
FIGS. 3A and 3B are schematic sectional views showing micro-dispersing apparatus for wax which has microopenings.
Figure 3B:
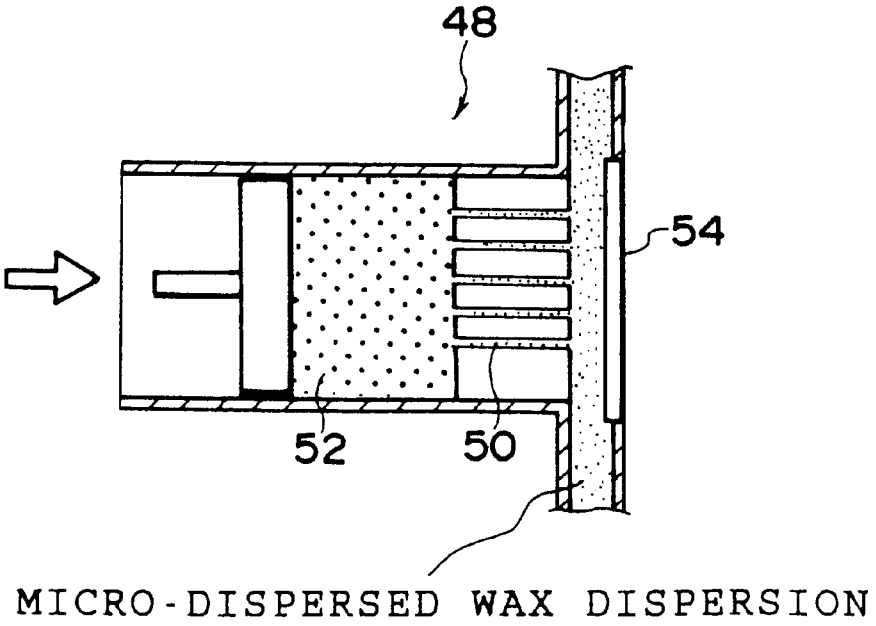

Typical examples of the means for preparing the wax dispersion are the apparatus shown in FIGS. 2A and 2B in which a clearance is opened when the pressure exceeeds a predetermined pressure to eject a mixed solution and the apparatus shown in FIG. 3A, which is provided with a fine opening (nozzle). In a wax micro-dispersing apparatus 40 shown in FIG. 2A, a mixture of wax and a solvent is charged into a cylinder 42 and the mixture is compressed in the direction indicated by the arrow in the cylinder 42 in FIGS. 2A and 2B. When the internal pressure exceeds a fixed pressure, a film 44 forms a clearance and the mixture is ejected from the clearance. The ejected mixture collides with a wall 46 at high speed, whereby the wax is micro-sized. Also, a wax micro-dispersing apparatus 48 shown in FIG. 3A is provided with a vessel 52 having pores 50. A mixed solution of wax and a solvent is charged into the vessel 52 and then pressure is applied to the mixed solution. The mixed solution cannot pass the pores when the pressure is low, but is ejected from the pores when the pressure is high enough. The ejected mixed solution collides with a wall 54 at high speed, whereby the wax is micro-sized as shown in FIG. 3B.

In this case, the higher the pressure, the higher the pulverizing force. The temperature is raised extremely, however, to cause the aggregation of wax. Hence, the pressure is preferably from 50 to 1,000 kg/cm$^2$ and more preferably from 150 to 700 kg/cm$^2$.

When preparing the wax dispersion, it is desirable that wax be thermally melted in a solvent or fused. Also, as required, the step of ejection at high pressure may be repeated. Wax particles may also be roughly dispersed in advance using a known wax-dispersing process.

There are no limitations to the binding resin used for the toner for developing an electrostatic latent image in the present invention. Conventionally known resins which are used as a resin for a toner may be used. Specific examples of the binding resin include a polyester resin, styrene resin, acryl resin, styrene-acryl resin, silicone resin, epoxy resin, diene-type resin, phenol resin, and ethylene-vinyl acetate resin. A polyester resin is preferable in view of melting capability when fixing and the smoothness of the image to be obtained.

Examples of monomers of the polyester resin include, as an alcohol component, polyoxypropylene (2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene (2,0)-polyoxyethylene(2,0)-2,2-bis(4-hydroxyphenyl)propane, polyoxypropylene (2,0)-polyoxyethylene(2,0)-2,2-bis(4-hydroxyphenyl)propane, diol or polyols such as ethylene glycol, diethylene glycol, triethylene glycol, polyethylene glycol, propylene glycol, dipropylene glycol, isopentyl glycol, dipropylene glycol, hydrogenated bisphenol A, 1,3-butane diol, 1,4-butane diol, neopentyl glycol, xylene glycol, 1,4-cyclohexane dimethanol, glycerol, trimethylolethane, trimethylolpropane, pentaerythritol, bis-(β-hydroxyethyl) terephthalate, tris-(β-hydroxyethyl) isocyanurate, and 2,2,4-trimethylolpentane-1,3-diol. A hydroxycarboxylic acid component may be added to the above alcohol component to provide the characteristics of a polyester resin. For example, as the hydroxycarboxylic acid component, p-oxybenzoic acid, vanillic acid, dimethylolpropionic acid, malic acid, tartaric acid, 5-hydroxyisophtharic acid, or the like can be used.

Given as specific examples of the acid component are malonic acid, succinic acid, glutaric acid, dimer acid, phthalic acid, isophthalic acid, terephthalic acid, dimethyl isophthalate, dimethyl terephthalate, monomethyl terephthalate, tetrahydroterephthalic acid, methyltetrahydrophthalic acid, hexahydrophthalic acid, dimethyltetrahydrophthalic acid, endmethylenehexahydrophthalic acid, naphthalenetetracarboxylic acid, diphenol acid, trimellitic acid, pyromellitic acid, trimesic acid, cyclopentadicarboxylic acid, 3,3',4,4'-benzophenonetetracarboxylic acid, 1,2,3,4-butanetetracarboxylic acid, 2,2-bis-(4-carboxyphenyl) propane, diimidecarboxylic acid prepared from trimellitic anhydride and 4,4-diaminophenylmethane, tris-(β-carboxyethyl) isocyanurate, isocyanurate ring-containing polyimidecarboxylic acid, tolylenediisocyanate, and isocyanate ring containing polyimidecarboxylic acid prepared from a trimer reaction product of xylylenediisocyanate or isophoronediisocyanate and trimellitic anhydride. These compounds may be used either independently or in combinations of two or more. Among these compounds, when a cross-linking component such as polyvalent (trivalent or more) carboxylic acid or polyvalent alcohol is used, sometimes preferable effects can be obtained in light of the stability of the fixing strength and resistance to offset.

Polyester resins prepared from these raw materials can be manufactured in a general process. It is convenient that the glass transition temperature of the polyester resin be from 40° C. to 80° C. and preferably from 50° C. to 70° C. Two or more of the above polyester resins may be combined to use as the binding resin of the present invention. Further, another resin may be combined to the extent that the effects of the present invention are not adversely affected. Examples of other resins include a styrene resin, acryl resin, styrene-acryl resin, silicone resin, epoxy resin, diene-type resin, phenol resin, terpene resin, coumarin resin, amide resin, imide resin, amide imide resin, butyral resin, urethane resin, and ethylene-vinyl acetate resin. In the present invention, it is preferable that polyester resin be used as a major component and other resins be added to the toner in an amount of from 0 to 30 parts by weight.

As the colorant dispersed in the above thermoplastic resin in the present invention, known organic or inorganic pigments or dyes, or oil-soluble dyes can be used. Examples of the colorant include C. I. Pigment Red 48:1, C. I. Pigment Red 57:1, C. I. Pigment Red 122, C. I. Pigment Yellow 17, C. I. Pigment Yellow 97, C. I. Pigment Yellow 12, C. I. Pigment Blue 15:1, C. I. Pigment Blue 15:3, lamp black (C. I. No. 77266), Rose Bengale (C. I. No. 45432), carbon black, nigrosine dye (C. I. No. 50415B), metal complex dye, derivatives of metal complex dye, and mixtures of these compounds. Further, various metal oxides such as silica, aluminum oxide, magnetite, various ferrites, cupric oxide, nickel oxide, zinc oxide, zirconium oxide, titanium oxide, and magnesium oxide, or the like can be used. Also, the mixture of these compounds can be selected optionally.

It is necessary that these colorants be contained in an amount enough to form a visible image having a sufficient density. The appropriate proportion of the colorant is from 1 to 100 parts by weight to 100 parts by weight of the toner, though it depends on the particle diameter of the toner and on the developed amount.

In this invention, a charge-controlling agent may be added as required. The charge-controlling agent is a compound selected from the group consisting of a metal salt of succinic acid, metal salt of salicylic acid, metal salt of alkylsalicylic acid, metal salt of catechol, metal containing bisazo dye, tetraphenyl borate derivatives, quaternary ammonium salt, and alkylpyridinium salt, or optional combinations of these compounds.

The amount of the charge-controlling agent is generally from 0.1% to 10% by weight, and preferably from 0.5% to 8% by weight to 100% by weight of the toner. If the amount is less than 0.1% by weight, the charge-controlling effect is insufficient, whereas if the amount exceeds 10% by weight, the toner resistance is excessingly reduced to where the toner is difficult to use.

In addition, a metal soap and an organic or inorganic metal salt can be used in combination with the above charge-controlling agent. Examples of the metal soap include aluminum tristearate; aluminum distearate; barium, calcium, lead, and zinc salts of stearic acid or cobalt, manganese, lead, and zinc salts of linoleic acid; aluminum, calcium, and cobalt salts of octanoic acid; calcium and cobalt salts of oleic acid; zinc palmitate; calcium, cobalt, manganese, lead, and zinc salts of napthenic acid; and calcium, cobalt, manganese, lead, and zinc salts of resinic acid. Acationic component among the inorganic and organic metal salts are a compound selected from the group of consisting of metals of the Ia group, IIa group, and IIIa group in the periodic law. An anionic component of the inorganic and organic salts is a compound selected from the group consisting of halogens, carbonates, acetates, sulfates, borates, nitrates, and phosphates. These charge controlling agent and cleaning adjuvant are formulated generally in an amount of from 1% to 10% by weight and preferably from 0.1% to 5% by weight to 100% by weight of the toner. If the amount is less than 1% by weight, a desired effect cannot be obtained, whereas if the amount exceeds 10% by weight, the fluidity of the toner powder decreases, which are both undesirable.

Next, the process for manufacturing the toner is described. In the present invention, the binding resin of the toner, which is represented by a polyester resin, colorant, and other additives which are used as required, is dissolved or dispersed in a solvent in which the resin is soluble to form an oil-phase. Examples of the solvent which can be used are generally hydrocarbons such as toluene, xylene, hexane, and the like; halogenated hydrocarbons such as methylene chloride, chloroform, dichloroethane, and the like; alcohols or ethers such as ethanol, butanol, benzyl alcohol, ether, tetrahydrofuran, and the like; esters such as methyl acetate, ethyl acetate, butyl acetate, isopropyl acetate, and the like; and ketones such as acetone, methyl ethyl ketone, diisobutyl ketone, cyclohexanone, methylcyclohexane, and the like. These solvents are primarily required to dissolve a polyester resin, but may or may not dissolve the colorant and other additives. The ratio by weight of the toner component to the solvent is preferably from 10/90 to 80/30 in view of easy granulation and toner yield.

Next, the prepared oil-phase is granulated in a water-phase (aqueous solvent) so as to form a predetermined particle size. A major medium in the water-phase is water. The inorganic dispersion stabilizers and/or organic dispersion stabilizers for forming a hydrophilic colloid may be added as required. As the inorganic dispersion stabilizer, calcium carbonate, magnesium carbonate, barium carbonate, tricalcium phosphate, hydroxyapatite, silicic acid diatomaceous earth, clay, or the like can be used. The particle diameter of the inorganic dispersion stabilizer is preferably 0.1 $\mu$m or less. It is desirable that the inorganic dispersion stabilizer be used after it is pulverized to a desired particle diameter using a wet dispersing machine such as a ball mill, sand mill, attritor, or the like. If the particle diameter of the inorganic dispersion stabilizer is 2 $\mu$m or more, the size distribution of the granulated toner is too broad and the prepared toner cannot be used.

Given as specific examples of the organic dispersion stabilizer which can be used in combination with the inorganic stabilizer are proteins such as gelatin, gelatin derivatives (for example, acetylated gelatin, phthalated gelatin, succinated gelatin, and the like), albumin, casein, and the like; collodion, gum arabic, agar, alginic acid, cellulose derivatives (for example, alkylesters of carboxymethyl cellulose, hydroxymethyl cellulose, carboxymethyl cellulose and the like); and synthetic polymers (polyvinyl alcohol, polyvinyl pyrrolidone, polyacrylamide, polyacrylate, polymethacrylate, polymaleate, polystyrene sulfonate, and the like). Among these organic dispersion stabilizers, compounds which forms a hydrophilic colloid are preferable. These organic dispersion stabilizers maybe used either independently or in combinations of two or more. It is desirable that the dispersant be used in an amount of from 0.001 parts by weight to 5 parts by weight to the principal medium in the water-phase.

A dispersion-stabilizing adjuvant may be added to the water-phase in combination. Various surfactants are preferably used as the dispersion-stabilizing adjuvant. The surfactants include ionic and nonionic surfactants. Given as examples of the anionic surfactant are alkylbenzene sulfonate, alkylphenyl sulfonate, alkylnaphthalene sulfonate, higher fatty acid salt, sulfate of higher fatty acid ester, sulfonate of higher fatty acid ester, and the like. As the cationic surfactant, primary to tertiary amine salts, quaternary ammonium salt, or the like can be used. As the nonionic surfactants, polyoxyethylenenonylphenyl ether, polyoxyethyleneoctylphenyl ether, polyoxyethylenedodecylphenyl ether, polyoxyethylenealkyl ether, polyoxyethylene fatty acid ester, sorbitan fatty acid ester, polyoxyethylenesorbitan fatty acid ester, fatty acid alkylolamide, or the like can be used. These dispersion-stabilizing adjuvants may be used either independently or in combinations of two or more. It is desirable to use these dispersion-stabilizing adjuvants in a proportion of from 0.001 to 5 parts by weight to the major components of the water-phase.

It is desirable that the ratio by weight of the oil-phase to the water-phase be generally from 10/90 to 90/10, although the ratio may change depending on the particle size obtained or production facilities.

The granulation of the oil-phase in the water-phase is preferably carried out under a high shearing condition.

Especially in the case where a particle diameter of from 5 to 9 μm is desired, it is necessary to consider the functions of a machine. In this case, it is necessary to select a dispersing machine equipped with a high-speed shearing device. Among various dispersing machines, an emulsifying machine of a high-speed blade rotation type or of a forced-interval pass type such as various homomixers, homogenizers, colloid mills, or the like are preferably used.

The solvent is removed at the same time in the step of granulating a toner or after the granulation step. The solvent may be removed at room temperature or under reduced pressure. When the removal of the solvent is carried out at room temperature, it is necessary to ensure that the temperature is lower than the boiling point of the solvent and the heating condition is determined in consideration of Tg of the resin. If the temperature excessively exceeds Tg, the undesirable coalesence of toner particles may occur. It is convenient to agitate around 40° C. for 3 to 24 hours in general. In a case where the process is performed under reduced pressure, the pressure is preferably in a range of from 20 to 150 mmHg.

The prepared toner is preferably washed with acids such as hydrochloric acid, nitric acid, formic acid, acetic acid, or the like, which allow the inorganic dispersion stabilizer to be soluble in water after the solvent has been removed. When the inorganic dispersion stabilizer and the above-described organic dispersion stabilizer remain on the surface of the toner, the moisture dependence of the charging characteristics of the toner is impaired due to the hygroscopicity of the residues and hence it is necessary to remove the inorganic and organic dispersion stabilizers remaining on the toner surface and thereby to eliminate adverse influences on the charging characteristics of the toner and on powder fluidity.

The toner washed with the above acid may be again washed with an aqueous alkali such as sodium hydroxide, if required, whereby part of the ionic materials on the toner surface, which have been changed to water-insoluble materials under an acidic environment, are again solubilized for removal, which is advantageous to the charging capability and powder fluidity.

Washing using an acid and aqueous alkali have an effect on washing and removal of wax freely adhering to the surface of the toner. Also, when these washing steps using both an acid and an alkali are performed, the toner is neutralized after wax and the like are removed, which is desirable in view of the efficiency for removing the acid or alkali in later steps. In a case where washing steps using an acid and alkali are performed, the sequence of steps is optional. In these washing steps, it is desirable to control conditions including the pH, washing time, washing temperature, and the like to promote washing efficiency. Also, it is desirable to use stirrer or ultrasonic dispersing machine to promote washing efficiency. Thereafter, steps of filtration, of decantation, of centrifugation, and the like are executed, if necessary, and then the toner is dried to obtain the toner particles of the present invention.

Also, known external additives may be added to the toner of the present invention in order to improve the fluidity and developing characteristics. As external additives, various inorganic oxide microparticles such as silica, alumina, titania, cerium oxide, and the like; and, as required, hydrophobic micro-particles, vinyl-type polymer, zinc stearate, and the like can be used. The external additive is preferably used in an amount of from 0.05 to 5 parts by weight of the toner without the additive.

The toner of the present invention can be formed into various shapes, having shapes from spherical to amorphous, or fine bumps, wrinkles, holes, or protrusions can be formed, on the surface of the toner by controlling process conditions, especially formulations of raw materials and the conditions in the step of evaporating the solvent from the toner after granulation. Specifically, it is desirable to control shape factor MLS2 in a range of from 100 to 140 in view of the characteristics of the developer to be obtained.

Here, shape factor MLS2 is defined as follows: 100 toner images magnified (magnification: 500 times) using, for example, FE-SEM (S=800, manufactured by Hitachi Ltd.) are sampled randomly. Image information is inputted, for example, to an image analyzer (Luzex-11, manufactured by Nireco Co., Ltd.) via an interface to analyze and thereby to calculate shape factor MLS2 according to the following formula:

$$MLS2=(\text{absolute maximum toner particle length})\ 2/(\text{toner particle projection area})\times\pi\times\tfrac{1}{4}\times 100$$

For the toner particle of the present invention, MLS2 can be controlled in a range of from 100 to 140 according to the above-mentioned manufacturing conditions. The shape of a toner produced by the conventional kneading-pulverizing process is amorphous. The MLS2 value of this toner measured is from 140 to 160. Incidentally, if MLS2 is 100, the shape is spherical.

The toner of the present invention can be used without any limitation in the conventionally known dry electrostatic charge developing process including a two-component developing process such as a cascade process, magnetic brushing process, microtoning process, or the like; a one-component developing process such as an electroconductive one-component developing process, an insulating one-component developing process, and the like; and a non-magnetic one-component developing process.

Also, the toner of the present invention can provide a unique process design in which low adhesiveness of the toner due to the spherical shape is effectively utilized. Namely, when using a full-color copy machine in which a plurality of toner images is developed and transferred, the amount of toner on a photosensitive member increases as compared to conventional monochrome toner. Therefore, it is difficult to improve the transfer efficiency only using conventional amorphous-shaped toner particles. Accordingly, in the formation of a color image, four-color toners are difficult to transfer with evenness. Further, when using an intermediate transfer, problems in unevenness of color and in color balance tend to occur, and hence it is difficult to stably output a full-color image of high quality. From the results of investigations on the correlation of these problem in transfer efficiency with the shape of the toner, it was confirmed that the reduction in the transfer efficiency of the toner was observed when the value of MLS2 exceeded approximately 140. The shape of the toner of the present invention can be controlled so that shape factor MLS2 is in a range of from 100 to 140. Specifically, the toner can be obtained by controlling the process conditions for manufacturing the toner so that shape factor MLS2 is in a range of from about 100 to about 120 suitable for enhancing transfer efficiency. Utilizing this high transfer efficiency of the toner of the present invention, a cleaning member can be omitted, and thus a compact and simple process can be designed.

The toner of the present invention can be combined with a carrier similar to conventional toners to form a developer for an electrostatic latent image suitable for the two-component developer.

Examples of the carrier for the two-component developer include iron powder, glass beads, ferrite powder, nickel powder, magnetite powder, materials produced by applying a resin on these materials, or a resin dispersion-type carrier produced by kneading-pulverizing a resin, charge controlling agent, and the like with magnetic materials and by classifying thereof. The carriers which can be used in combination with the toner are preferably those with a resin coating layer on the inorganic particles produced in the above manner.

Next, an image-forming method according to the present invention is described below. The image-forming method according to the present invention comprises a step of forming a latent image on an image-bearing substrate; a step of developing the latent image using a developer for an electrostatic latent image; and a step of transferring the developed toner image onto a transfer member; wherein the developer is toner including a binding resin, a colorant and wax; and the toner contain from 0.1% to 40% by weight of wax; the amount of wax disposed on the surface of the toner particle is from 1% to 10% by weight; and the number-average dispersion diameter of wax is from 0.1 to 2 $\mu$m.

The process designed using the toner of the present invention will be now explained based on embodiments; this embodiment shall not, however, be construed as limiting the invention provided that the toner of the present invention is used.

Figure 4:
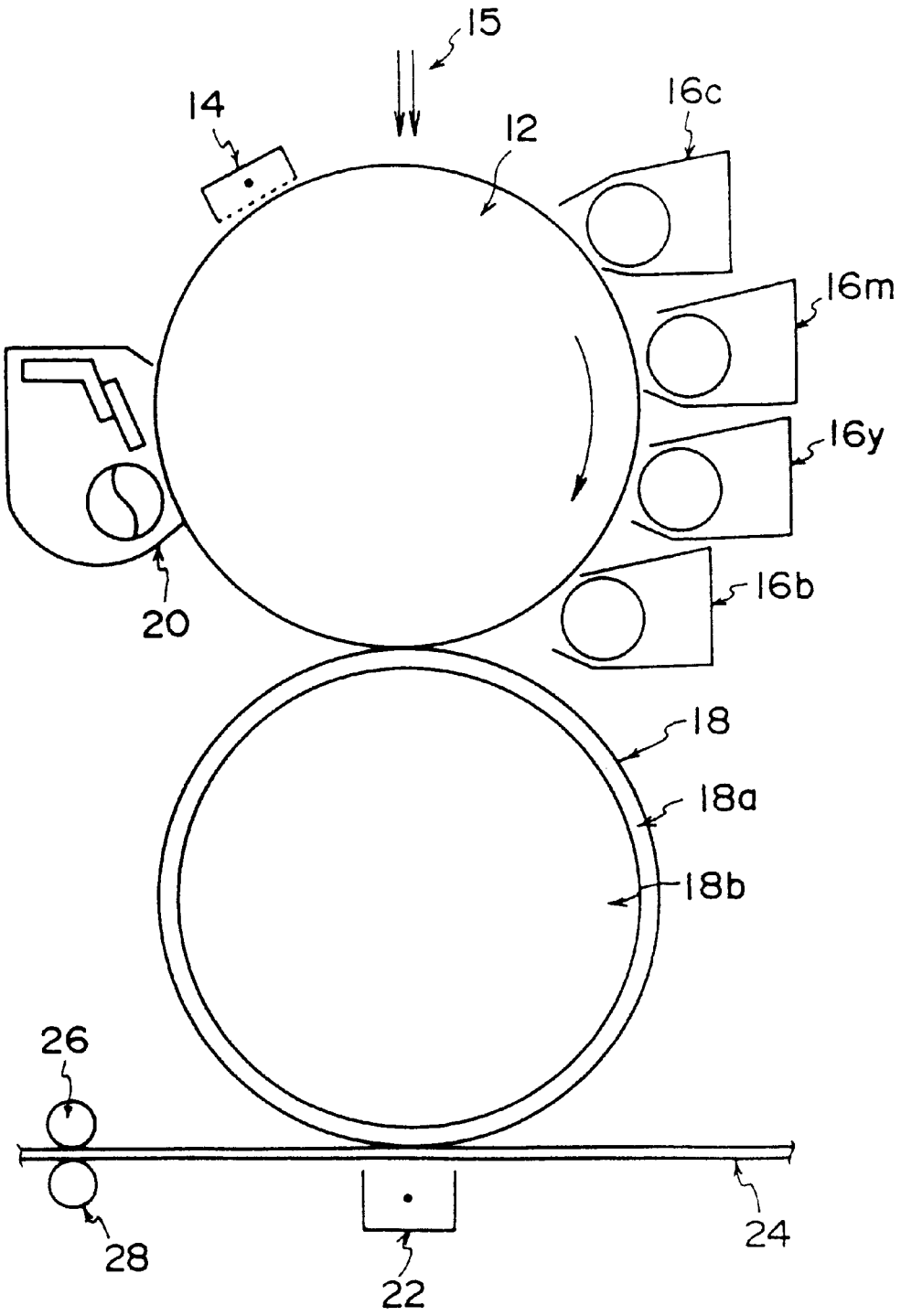
FIG. 4 is a schematic view showing a structure of an image-forming apparatus used in an image-forming method in Example 1.

FIG. 4 is a schematic view showing a structure of an image-forming apparatus 10 used in an image-forming method according to the present invention.

A photosensitive member 12 is composed of a photosensitive drum or a belt including a photoconductive insulating layer such as a-Se, OPC, a-Si, and ZnO. Among these, OPC or a-Si photosensitive member is preferably used. In a charging step in a step of forming an latent image in the present embodiment, a corona charger 14 is used and, specifically, a system of non-contact with the photosensitive member is adopted. Other than this non-contact system, contact systems using a roller or brush can be used. The latent image which is formed in an exposing unit 15 after charging is conveyed to a developing unit. The present embodiment is a full-color machine and hence developers of cyan, magenta, yellow, and black are introduced into developing units 16*c*, 16*m*, 16*y*, and 16*b*. A developing system may be either a magnetic brush developing system or a non-magnetic one-component developing system. An intermediate transfer member 18 comprises a pipe-shaped electroconductive core 18*b* and an elastic layer 18*a* where electric resistance is controlled. Further, as required, removable cleaning means 20 is provided as shown in FIG. 4. The toner image on the intermediate transfer member 18 is charged with a bias of a polarity adverse to the frictional charge of the toner by a charger 22 and transferred onto the surface of a transfer material 24. The transfer material 24 onto which the toner image is transferred passes between a heating roller (heat-fixing roller) 26, incorporated with a heating member such as ahalogen heater, and an elastic pressure roller 28 which is pressed to the heating roller 26, whereby the toner image is fixed to the transfer material 22.

Even in the case of using such a simple apparatus, a high-quality image can be formed using the toner of the present invention which can satisfy conditions of both oilless fixing capability and transfer property.

EXAMPLES

The present invention is now explained in more detail by way of examples and comparative examples, which, however, shall not be construed as limiting the present invention. Incidentally, the word "parts" in examples and comparative examples denotes "parts by weight".

Developer evaluation method (1) Evaluation of developing capability and fixing capability of toner As an image output evaluation apparatus, a modified apparatus of A Color 635 m (manufactured by Fuji Xerox Co., Ltd.) was used. FIG. 4 is a schematic view of the image output evaluation apparatus. When evaluating oilless fixing capability, oil is not supplied to a heat fixing roller.

Experimental conditions are as follows:

Photosensitive member: OPC (84 mm in diameter)

ROS: LED (400 dpi)

Process speed: 160 mm/s

Latent image potential: Background: −550V; image portion: −150 V.

Developing roller(common to developing units 1 to 4):

Magnet: fixed; sleeve: rotate; flux density of magnet: 500 G on sleeve; diameter of sleeve: $\phi$25; rotation speed of sleeve: 300 mm/s.

Clearance between photosensitive member and developing roller (common to developing units 1 to 4): 0.5 mm Clearance between developer layer thickness controlling member and developing roller (common to developing units 1 to 4): 0.5 mm Developing bias (common to developing units 1 to 4): DC component: −500 V; AC component: 1.5 kVP-P (8 kHz)

Transfer condition:

Corotron transfer (diameter of wire=85 $\mu$m)

Fixing condition: Fluorine roller, oilless

Evaluation circumstance: Ordinary temperature and ordinary humidity (23° C., 50% RH) and high temperature and high humidity (28° C., 80% RH)

Image evaluation

Image density: Color-reflection densitometer X-Rite 404A)

Reproducibility of color tone: Formed an image on OHP film sheet and measured the transmittance of each color at the following wave lengths: Used a spectrophotometer (U-3210, manufactured by Hitachi Ltd.) as an apparatus for measuring transmittance.

Cyan: 480 nm

Magenta: 680 nm

Yellow: 580 nm

Evaluation of strength of fixed image: Formed an image on a normal sheet and determined according to the following criteria:

Good: When an image fixed at 180° C. (roller temperature) was rubbed, toner peeling was not observed.

Bad: When an image was rubbed, toner peeling was observed.

(2) Transfer efficiency evaluation

Transfer efficiency 1 from the photosensitive member to the intermediate transfer member was measured as follows: The toner image on the photosensitive member was sampled using transparent adhesive tape and the toner image was measured using a color-reflection densitometer. Next, a toner image was again formed, the toner image transferred to the intermediate transfer member was sampled using transparent adhesive tape, and the image density was measured. The transfer efficiency was calculated according to the following formula:

transfer efficiency 1=(image density of toner sampled from intermediate transfer member)/(image density of toner sampled from photosensitive member).

Transfer efficiency 2 from intermediate transfer member to transfer material measured the same way according to the following formula:

transfer efficiency 2=(image density of toner sampled from transfer material)/(image density of toner sampled from intermediate transfer member)

The overall transfer efficiency was calculated according to the following formula:

Overall transfer efficiency=transfer efficiency 1×transfer efficiency 2

(3) Evaluation of toner heat blocking 5 g of a toner was allowed to stand in a chamber at 45° C. under a humidity of 50% RH for 17 hours. After the temperature was cooled to room temperature, 2 g of the toner was charged into a mesh with a mesh size of 45 μm and shaken in a fixed condition. The amount of toner remaining on the mesh was measured and the ratio by weight of the remaining toner was calculated. This calculated value was defined as the toner heat blocking index.

Example 1

(A) Preparation of pigment dispersion

A pigment dispersion was prepared according in the following sequence:

| | | |
|---|---|---|
| 1. | Polyester resin R-1 (Details are described in Table 1.) (Tg: 63° C.; softening point: 102° C.; weight-average monocular weight: 9,000) | 50 parts |
| 2. | Copper phthalocyanine pigment (C. I. Pigment Blue 15:3; Cyanine Blue 4933M; Dainichiseika Color and Chemicals Mfg. Co., Ltd.) | 50 parts |
| 3. | Ethyl acetate | 100 parts |

TABLE 1

| Monomer | R-1 | R-2 | R-3 | R-4 | R-5 | R-6 |
|---|---|---|---|---|---|---|
| Polyoxypropylene(2,2)-2,2bis-(4-hydroxyphenyl)propane | 100 parts | 100 parts | 100 parts | 100 parts | 100 parts | 100 parts |
| Terephthalic acid | 100 parts | 80 parts | 80 parts | 90 parts | 95 parts | 90 parts |
| Isophthalic acid | | 20 parts | | | | |
| Maleic anhydride | | | 20 parts | | | |
| Trimellitic anhydride | | | | 10 parts | | |
| Dodecenyl succinic acid | | | | | 5 parts | |
| Ethylene glycol | | | | | | 10 parts |
| Dibutyl tin oxide (catalyst) | 0.1 parts | 0.1 parts | 0.1 parts | 0.1 parts | 0.1 parts | 0.1 parts |
| Glass transition temperature (° C.) | 63 | 65 | 68 | 69 | 59 | 61 |

Glass beads were added to a dispersion having the above compositions and the mixture was placed in a sand mill dispersing apparatus. The mixture in a dispersing vessel was dispersed in high-speed stirring mode for 3 hours while cooling around the dispersing vessel to a pigment dispersion with a pigment of a concentration of 10% by weight.

(B) Preparation of wax micro-particles

A dispersion containing wax micro-particles was prepared in the following procedures:

| | | |
|---|---|---|
| 1. | Paraffin wax (Melting point: 85° C.; latent heat of melting: 193 mJ/mg) | 15 parts |
| 2. | Toluene | 85 parts |

The above materials were placed in a dispersing machine equipped with a stirring blade and a vessel having a means of circulating a heating medium around thereof. The temperature was gradually increased while agitating the mixture at a rotation of 83 rpm and the mixture was finally agitated while keeping the temperature at 100° C. Next, the temperature was gradually cooled to room temperature at a rate of 2° C./minute while continuing agitation to precipitate wax micro-particles. Using a laser diffraction/scattering size distribution measuring apparatus (LA-700, manufactured by Horiba Seisakusho Ltd.), the average diameter of the wax micro-particles was measured. The average diameter of the wax microparticle was approximately 1.02 μm. The wax was again dispersed using a high-pressure emulsifier (APV Gaulin Homogenizer 15MR) under a pressure of 500 kg/cm$^2$. The particle diameter of the wax was measured the same as above. The measured diameter was 0.81 μm. It was confirmed that the wax was flake-shaped from an SEM photograph. The dispersion in which the wax micro-particles were dispersed was diluted by adding ethyl acetate so that the concentration by weight of the wax was 15% by weight.

(C) Preparation of oil-phase

A toner oil-phase was prepared in the following sequence:

| | | |
|---|---|---|
| 1. | Polyester resin R-1 (Details are described in Table 1.) (Tg: 63° C.; softening point: 102° C.; weight-average molecular weight: 9,000) | 85 parts |
| 2. | Pigment dispersion: (Concentration of pigment: 10% by weight) | 50 parts |
| 3. | Dispersion of wax microparticles: (Concentration of wax: 15% by weight) | 33 parts |
| 4. | Ethyl acetate | 32 parts |

After the polyester resin was completely dissolved in the oil-phase having the above composition, the oil-phase was placed in a homomixer (Ace Homogenizer, manufactured by Nippon Seiki Co., Ltd.) and agitated at 15,000 rpm for 2 minutes to prepare a homogeneous oil-phase.

(D) Preparation of water-phase

A water-phase was prepared in the following sequence:

| | | |
|---|---|---|
| 1. | Calcium carbonate: (Average particle diameter: 0.03 μm) | 60 parts |
| 2. | Purified water | 40 Parts |

The above materials were stirred using a ball mill for 4 days. Using the above-mentioned laser diffraction/scattering size distribution measuring apparatus (LA-700, manufactured by Horiba Seisakusho Ltd.), the average particle diameter of the calcium carbonate was measured. The average diameter of the calcium carbonate was approximately 0.08 μm. On the other hand, the following materials were blended to prepare another water-phase:

| | | |
|---|---|---|
| 1. | Carboxylmethyl cellulose (Celogen BSH; Dai-ichi Kogyo Seiyaku Co., Ltd.) | 2 parts |
| 2. | Purified water | 98 parts |

(E) Process for manufacturing toner

The following materials were used for manufacturing toner:

| | |
|---|---|
| 1. Oil-phase (C): | 60 parts |
| 2. Calcium carbonate solution (D) | 10 parts |
| 3. Carboxylmethyl cellulose solution (D) | 30 parts |

The above materials were placed in a colloid mill (manufactured by Nippon Seiki Co., Ltd.) and emulsified at 8,000 rpm for 20 minutes at a gap space of 1.5 mm. Next, the produced emulsion was placed in a rotary evaporator and the solvent was distilled away at room temperature under reduced pressure of 30 mmHg for 3 hours. Then, the pH was adjusted to 2 by the addition of 12N hydrochloric acid to remove calcium carbonate from the toner surface. Thereafter, 10N sodium hydroxide was added until the pH became to 10, and further agitated with a stirrer for 1 hour in an ultrasonic washer. Then, the resulting mixture was subjected to a centrifugation, and washed by changing the supernatant 3 times, followed by drying to prepare toner. The volumetric average particle diameter of the toner measured using a Coulter Counter (TA-11, manufactured by Coulter Co., Ltd.) was 7.8 μm. Also, the geometric standard division (GSD), calculated from the square root of d84/d16 which was a volumetric average particle diameter) which was an index of the size distribution was 1.22 and shape factor MLS2 was 107.

Also, the content of wax inside the toner, which was calculated based on the endothermic peak area of the wax measured by differential thermal analysis (DSC) using a thermal analysis apparatus DSC3110 (manufactured by Mac Co., Ltd.) was 4.8% by weight. It was confirmed that the wax was flake-shaped from an SEM photograph.

Further, the colorant was replaced by C. I. Pigment Yellow 17, C. I. Pigment Red 57, and Carbon black (#4000, manufactured by Mitsubishi Chemical Industries Ltd.) to prepare yellow, magenta, and black toners, respectively, the same as above. Physical properties of the toners thus obtained are shown in Table 2.

TABLE 2

| Toner | Volumetric average particle diameter (μm) | GSD | MLS2 | Amount of wax on surface (% by weight) | Diameter of wax dispersion (μm) |
|---|---|---|---|---|---|
| Cyan | 7.8 | 1.22 | 107 | 7.1 | 1.2 |
| Yellow | 7.8 | 1.25 | 108 | 5.8 | 0.8 |
| Magenta | 7.1 | 1.29 | 108 | 4.3 | 1.1 |
| Black | 7.0 | 1.23 | 107 | 6.9 | 0.9 |

(F) Preparation of developer and evaluation by using an actual machine

To the toner prepared in process (E) above was added 0.5% by weight of silica (R972, manufactured by Nippon Aerosil Co., Ltd.) using a Henshel mixer. An F300 (manufactured by Powder Tech Co., Ltd.) as a carrier core was coated with 0.5 parts by weight of methyl methacrylate using a kneader to prepare the carrier. The above toner and the carrier were mixed so that the concentration by weight of the toner was 8% to prepare a developer. The developer of each color had a charge of from −15 to −20 μC/g. The transfer efficiency of the toner of each color from the photosensitive member 12 to the intermediate transfer member 18 was from 98% to 99% and the transfer efficiency of the toner of each color from the intermediate transfer member 18 to the transfer material 24 was from 98% to 99%. The overall transfer efficiency was from 96% to 98%. Also, the image exhibited a high resolving power and there was no offset of the toners onto the transfer material.

Further, 30,000 sheets were continuously copied. As a result, an image after 30,000 copies was excellent, which had the same quality as that at the beginning of copying. Also, an image was evaluated under conditions of high temperature and high humidity. However, no image smear was found. Results of the image hot offset temperature, the fixing strength, the OHP film transmittance, and the heat storability index of the toner for each color are shown in Table 3.

TABLE 3

| | Offset temperature (°C.) (evaluation) | Fixing strength (cover printing method) | OHP film trans-mittance (%) | Heat blocking index (%) (evaluation) |
|---|---|---|---|---|
| Cyan toner | 190 (○) | No problem | 89 | 5.3 (○) |
| Yellow toner | 200 (○) | No problem | 90 | 4.9 (○) |
| Magenta toner | 190 (○) | No problem | 89 | 3.1 (○) |
| Black toner | 200 (○) | No problem | — | 3.9 (○) |

Evaluation criteria:
Offset temperature:
× lower than 150° C.
Δ 150° C. or higher and less than 180° C.
○ 180° C. or higher
Heat blocking index
○ less than 6%
Δ 6% or more and less than 10%
× 10% or more Example 2–Example 6

A toner was prepared in the same manner as in Example 1 except that polyester resin R-1 was replaced by polyester R-2 to R-6 having the monomer species shown in Table 1 and the pigments, and waxes shown in Table 4 were used. Also, the content of wax inside the toner was 4.7, 4.9, 4.6, 4.7, and 4.5% by weight, respectively. Results evaluated the same as in Example 1 are shown in Table 4.

Example 7

(A) A pigment dispersion was prepared according to the following sequence:

| | |
|---|---|
| 1. Styrene-n-butyl acrylate resin: (Copolymerization ratio 70:30; Tg: 65° C.; weight-average molecular weight: 200,000) | 50 parts |
| 2. C. I. Pigment Blue 15:3 (Dainichiseika Color and Chemicals Mfg. Co. Ltd.) | 50 parts |
| 3. Ethyl acetate | 100 parts |

Glass beads were added to a dispersion having the above composition and placed in a sand mill disperser. The mixture in a dispersing vessel was dispersed in high-speed stirring mode for 3 hours while cooling around the dispersing vessel to prepare a pigment dispersion with a pigment concentration of 10% by weight.

(B) A dispersion containing wax micro-particles was prepared according to the following sequence:

| | |
|---|---|
| 1. Paraffin wax: (Melting point: 85° C.; latent heat of melting: 193 mJ/mg) | 15 parts |
| 2. Toluene | 85 parts |

The above materials were placed in a dispersing machine equipped with a stirring blade and a vessel having a means of circulating a heating medium around thereof. The temperature was gradually increased while agitating the mixture at a rotation of 83 rpm and finally the mixture was agitated while keeping the temperature at 100° C. for three hours. Next, the temperature was gradually cooled to room temperature at a rate of 2° C./minute while continuing agitation to precipitate wax micro-particles. Using a laser diffraction/scattering size distribution measuring apparatus (LA-700, manufactured by Horiba Seisakusho Ltd.), the average diameter of the wax particles was measured. The average diameter of the wax particles was approximately 0.85 μm. It was confirmed that the wax was flake-shaped from an SEM photograph. The dispersion in which the wax micro-particles were dispersed was diluted by adding ethyl acetate so that the concentration by weight of the wax was 15%.

(C) A toner oil-phase was prepared in the following sequence:

| | |
|---|---|
| 1. Styrene-n-butyl acrylate resin: (Copolymerization ratio: 70:30, Tg: 65° C., weight-average molecular weight: 200,000) | 85 parts |
| 2. Pigment dispersion: (Concentration of pigment: 10% by weight) | 50 parts |
| 3. Dispersion of wax microparticles: (Concentration of wax: 15% by weight) | 33 parts |
| 4. Ethyl acetate | 22 parts |
| 5. Aluminum 3,5-di-t-butyl salicylate | 10 parts |

After the polyester resin was completely disolved in the oil-phase having the above composition, the oil-phase was placed in a homomixer (Ace Homogenizer, manufactured by Nippon Seiki Co., Ltd.) and agitated at 15,000 rpm for 2 minutes to prepare a homogeneous oil-phase.

(D) A water-phase was prepared in the following sequence:

| | |
|---|---|
| 1. Calcium triphosphate (average diameter: 0.09 μm) | 60 parts |
| 2. Purified water | 40 parts |

The above materials were stirred using a ball mill for 4 days. Using the above-mentioned laser diffraction/scattering size distribution measuring apparatus (LA-700, manufactured by Horiba Seisakusho Ltd.), the average diameter of the calcium triphosphate particles was measured. The average diameter of the calcium triphosphate particles was approximately 0.09 μm. On the other hand, an aqueous solution containing 2% by weight of polyvinyl alcohol (degree of polymerization: 2,000) was prepared separately.

(E) The following materials were used for manufacturing a toner:

| | |
|---|---|
| 1. Oil-phase prepared by the above process(C): | 60 parts |
| 2. Aqueous calcium carbonate solution prepared by the above process (D): | 10 parts |
| 3. Aqueous polyvinylalcohol prepared by the above solution (D): | 30 parts |

The above materials were placed into a colloid mill (manufactured by Nippon Seiki Co., Ltd.) and emulsified at 8,000 rpm for 20 minutes at a gap space of 1.5 mm. Next, the resultant emulsion was placed in a rotary evaporator and the solvent was distilled away at room temperature under a reduced pressure of 30 mmHg for 3 hours. Then, the pH was adjusted to 2 by adding 12N hydrochloric acid and the calcium carbonate removed from the toner surface. The resulting mixture was then subjected to centrifugation, and washed by changing the supernatant 3 times, followed by drying to prepare a toner. The average particle size of the toner was 8.5 μm, and the GSD was 1.20, which were satisfactory. Also, the content of wax inside the toner was 5.0% by weight. It was confirmed that the wax was flake-shaped from an SEM photograph. The image offset temperature was 200° C. The fixing strength was satisfactory. Also, the heat storability index of the toner was 4.5%. Evaluation using an actual machine was performed by preparing a developer in the same way as in Example 1. The produced image exhibited a high resolving power. Further, 30,000 sheets were continuously copied. The image after 30,000 copies was excellent and had the same quality as that in the beginning of copying. Also, an image was evaluated under conditions of high temperature and high humidity. However, no image smear was found. Results are shown in Table 4.

Example 8

710 parts by weight of ion exchange water and 60 parts by weight of calcium carbonate (luminous, manufactured by Maruo Calcium Co., Ltd.) were placed in a four-necked flask equipped with a high-speed stirring apparatus (TK homomixer) to prepare an aqueous dispersion medium.

On the other hand, a dispersoid was prepared using the following components:

| | |
|---|---|
| Styrene monomer | 165 parts |
| n-butyl acrylate monomer | 35 parts |
| C. I. Pigment Blue 15:3 | 14 parts |
| Negative charge controlling agent (dialkyl salicylate acid compound) | 2 parts |

-continued

| | |
|---|---|
| Paraffin wax (Melting point: 85° C. average particle size: 0.85 μm; flake-shaped wax) | 15 parts |

The above components were mixed and dispersed using an attriter for 3 hours and then 10 parts by weight of 2,2'-azobis(2,4-dimethylvaleronitrile), which is a polymerization initiator, was added to the mixture to prepare a polymerizable monomer composition (oil-phase component). This oil-phase component was added to the above aqueous dispersion medium.

The mixture was stirred at 80° C. for 8 hours. After the completion of polymerization, the obtained slurry was cooled. Dilute hydrochloric acid was added to the slurry to remove the dispersion stabilizer and the mixture was dried to prepare toner all with an average particle diameter of 7.5 μm. The content of the wax on the surface was 1.2% by weight and shape factor MLS2 was 108. Also, the content of the wax inside the toner was 6.3% by weight. It was confirmed that the wax was flake-shaped from an SEM photograph. The image offset temperature was 180° C. The fixing strength was satisfactory. The OHP film transmittance was 81%. Evaluation using an actual machine was performed by preparing a developer the same as in Example 1. The produced image exhibited a high resolving power. Further, 30,000 sheets were continuously copied. The image after 30,000 copies was excellent and had the same quality as that at the beginning of copying. Also, an image was evaluated under conditions of high temperature and high humidity, and no image smear was found. Results are shown in Table 4.

Example 9

A pigment dispersion was prepared according to the following sequence:

| | |
|---|---|
| 1. Polyester resin R-1 (described in Table 1) (Tg: 63° C.; softening point: 102°0 C.; weight-average molecular weight: 9,000) | 45 parts |
| 2. Copper phthalocyanine pigment (C. I. Pigment Blue 15:3, Cyanine Blue 4933M, manufactured by Dainichiseika Color & Chemicals Mfg. Co., Ltd.) | 50 parts |
| 3. Ethyl acetate | 100 parts |
| 4. Charge controlling agents (boron compound of salicylic acid) | 5 parts |

Glass beads were added to a dispersion having the above formulations and the mixture was placed in a sand mill dispersing apparatus. The mixture was dispersed in high-speed stirring mode in a dispersing vessel for 3 hours while cooling around the dispersing vessel to prepare a pigment dispersion with a concentration of 10% by weight of the pigment. The toner particle was prepared in the same manner as in Example 1 except that the above dispersion was used. The average particle diameter of the toner was 7.0 μm and the GSD was 1.30. The content of wax in the toner was 4.8% by weight. It was confirmed that the wax was flake-shaped from an SEM photograph. Further, external additives were added to this the same as in Example 1 to obtain toner. The image evaluation for the toner was conducted the same as in Example 1 except that the non-magnetic one-component developing machine shown in FIG. 5 was used for the evaluation instead of the developing machine shown in FIG. 4.

Figure 5:
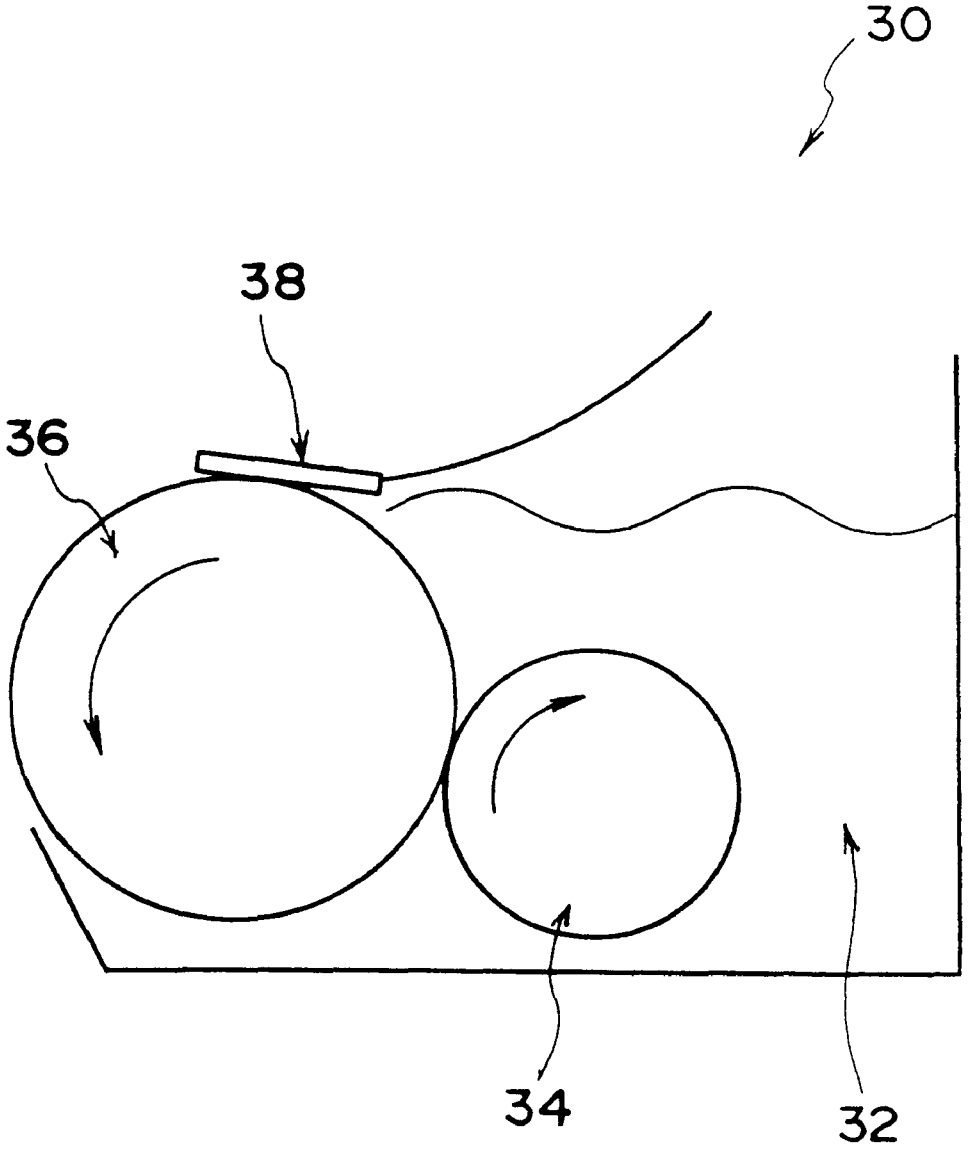
FIG. 5 is a schematic view showing a structure of a non-magnetic one-component developing machine used in an image-forming method in Example 9.

FIG. 5 is a schematic view showing a structure of a non-magnetic one-component developing machine used in this example. In the non-magnetic one-component developing machine 30, toner is kept in a toner receiver 32. A toner layer is formed on a developing roller 36 by frictional force between a feed roller 34 and the developing roller 36. The toner layer is optionally controlled to a desired thickness by a controlling blade 38 and the toner is then supplied to the photosensitive member (not shown).

An image was formed according to this system. As a result, the transfer efficiency of toner from the photosensitive member 12 to the intermediate transfer member 18 was from 98% to 99% and the transfer efficiency of toner from the intermediate transfer member 18 to the transfer material 24 was from 98% to 99%. The overall transfer efficiency was from 96% to 98%. Also, the image exhibited a high resolving power and there was no offset of the toner onto the transfer material. Further, 5,000 sheets were continuously copied. As a result, an image after 5,000 copies was satisfactory and had the same quality as that at the beginning of copying. Also, an image was evaluated under conditions of high temperature and high humidity, and no image smear was found.

Comparative Example 1

A toner was prepared the same manner as in Example 1 except that polypropylene wax (melting point: 140° C.; latent heat of melting: 290 mJ/mg) was used instead of the wax in Example 1. The measured average particle size of the wax was about 3.9 μm. Also, the average particle size of the toner was 8.3 μm, the GSD was 1.35, and the content of wax inside the toner was 4.7% by weight. It was confirmed that the wax was flake-shaped from an SEM photograph. Image offset occurred at a temperature of 145° C., and the oilless fixing capability was insufficient. The heat storability index of the toner was 8.4%. Evaluation using an actual machine was performed by preparing a developer the same as in Example 1. The OHP film image was dark in the halftone. The resulting image exhibited a high resolving power. Further, 30,000 sheets were continuously copied. The image after 30,000 copies had deteriorated slightly when compared to the image at the beginning of copying. Results are shown in Table 4.

Comparative Example 2

The materials below were kneaded by a melt-kneading process. After pulverizing, a size-classifying process was conducted to obtain a toner having an average particle size of 7.8 μm and a GSD of 1.30. Shape factor MLS2 was 152 and the content of wax on the surface was 54% by weight. Also, the content of wax inside the toner was 4.9% by weight. It was confirmed that the wax was spherical from an SEM photograph.

| | |
|---|---|
| 1. Polyester resin R-1: (Tg: 65° C.; softening point: 102° C.; weight-average molecular weight: 9,000) | 90 parts |
| 2. Copper phthalocyanine pigment: (Cyanine Blue 4933M; manufactured by Dainichiseika Color and Chemicals Mfg. Co., Ltd.) | 5 parts |
| 3. Paraffin wax: (Melting point: 85° C.; latent heat of melting: 193 mJ/mg) | 5 parts |

Image offset occurred at a temperature of 190° C. Though the oilless fixing capability was sufficient, the heat storability index of the toner was 19%, which was extremely unsatisfactory. The OHP film image was dark in the halftone. Evaluation using an actual machine was performed by preparing a developer the same as in Example 1. The transfer efficiency of the toner from the photosensitive member 12 to the intermediate transfer member 18 was from 85% to 87% and the transfer efficiency of the toner from the intermediate transfer member 18 to the transfer material 24 was 90%. The overall transfer efficiency was from 76% to 78%. Further, in continuous copying, fog occurred after approximately 1,000 copies and the image quality deteriorated. After 1,000 copies, fog further accelerated and contamination inside the machine increased after 5,000 copies. Also, an image was evaluated under conditions of high temperature and high humidity. Increased image smear was found. Results are shown in Table 4.

Comparative Example 3

Irregularly shaped toner was prepared the same as in Comparative Example 2 except that the content of paraffin wax was changed to 1% by weight. The MLS2 was 153 and the content of wax on the surface was 48% by weight. Also, the content of wax inside the toner was 0.8% by weight. It was confirmed that the wax was spherical from an SEM photograph. Although the oilless fixing capability was sufficient, the heat storability index of the toner was 16%, which was extremely unsatisfactory. Evaluation using an actual machine was performed by preparing a developer the same as in Example 1. The transfer efficiency of the toner from the photosensitive member 12 to the intermediate transfer member 18 was from 87% to 89% and the transfer efficiency of the toner from the intermediate transfer member 18 to the transfer material 24 was from 90%. The overall transfer efficiency was from 78% to 80%. Further, in continuous copying, fog occurred after about 1,000 copies and image quality deteriorated. After about 1,000 copies, fog further accelerated and contamination inside the machine increased after 5,000 copies. Also, an image was evaluated under conditions of high temperature and high humidity. Increased image smear was found. Results are shown in Table 4.

Comparative Example 4

Irregularly shaped toner was prepared the same as in Comparative Example 2 except that the content of paraffin wax was changed to 15% by weight. The MLS2 was 153 and the content of wax on the surface was 59% by weight. Also, the content of wax inside the toner was 14.5% by weight. It was confirmed that the wax was spherical from an SEM photograph. The heat storability index of the toner was 25%, which was extremely unsatisfactory. Also, only uneven transferred images were obtained. In continuous copying using 500 sheets, fusion-adhesion to the photosensitive member occurred frequently. Results are shown in Table 4.

Comparative Example 5

An oil-phase material (C) was prepared the same as in Example 1 except that 2.5 parts of polyvalent isocyanate (Takenate D110N, manufactured by Takeda Chemical Industries Ltd.) and 2.5 parts of silyl isocyanate (SI310, manufactured by Matsumoto Kosho Co., Ltd.) were added to the oil-phase material (C) in Example 1. A capsule-type toner provided with a shell material layer of polyurea on the surface thereof was prepared from the oil-phase material (C) the same as in (E) in Example 1. The MLS2 was 110 and the content of wax on the surface of the toner was 0.5% by weight. Also, the content of wax inside the toner was 4.4% by weight. It was confirmed that the wax was flake-shaped from an SEM photograph.

The oilless fixing capability was evaluated. As a result, the offset start temperature was 145° C., which was insufficient. Also, OHP film transmittance was 78%. A developer was prepared the same as in Example 1. Using the developer, an image was formed. However, the surface glossiness was low and the image was of low quality. Results are shown in Table 4.

TABLE 4

| | | | Wax | | | | Toner property | | | |
|---|---|---|---|---|---|---|---|---|---|---|
| | | | | | | | Volumetric | | Amount of | |
| | Resin | Pigment | Material | Melting point (° C.) | Latent heat of fusion (ml/mg) | Particle diameter (μm) | average particle diameter (μm) | MLS2 | wax on surface (% by weight) | Diameter of wax dispersed (μm) |
| Ex. 2 | Polyester resin R-2 | C.I. Pigment Blue 15:3 | Paraffin | 75 | 170 | 0.8 | 7.8 | 105 | 7.1 | 0.6 |
| Ex. 3 | Polyester resin R-3 | C.I. Pigment Red 57 | Micro-crystalline | 101 | 205 | 1.1 | 8.2 | 106 | 5.6 | 0.9 |
| Ex. 4 | Polyester resin R-4 | C.I. Pigment Yellow 180 | Maleic anhydride modified polyethylene | 105 | 210 | 1.3 | 7.6 | 109 | 6.3 | 0.9 |
| Ex. 5 | Polyester resin R-5 | C.I. Pigment Red 122 | Paraffin | 85 | 193 | 0.85 | 5.5 | 108 | 2.2 | 1.5 |
| Ex. 6 | Polyester resin R-6 | C.I. Pigment Yellow 97 | Ester wax | 80 | 183 | 0.73 | 6.3 | 105 | 8.4 | 1.9 |
| Ex. 7 | Styrene-acryl resin | C.I. Pigment Blue 15:3 | Paraffin | 85 | 193 | 0.87 | 8.5 | 103 | 5.8 | 0.9 |
| Ex. 8 | Styrene-acryl resin | C.I. Pigment Blue 15:3 | Paraffin | 85 | 193 | 0.85 | 7.5 | 108 | 1.2 | 0.9 |
| Comp. Ex. 1 | Polyester resin R-1 | C.I. Pigment Blue 15:3 | Polypropylene | 140 | 290 | 3.9 | 8.3 | 105 | 7.5 | 4.1 |
| Comp. Ex. 2 | Polyester resin R-1 | C.I. Pigment Blue 15:3 | Paraffin | 96 | 193 | 3.5 | 7.8 | 152 | 54 | 2.3 |
| Comp. | Polyester | C.I. Pigment | Paraffin | 85 | 193 | 3.5 | 7.1 | 153 | 48 | 2.5 |

TABLE 4-continued

| | | | | | | | | | | |
|---|---|---|---|---|---|---|---|---|---|---|
| Ex. 3 | resin R-1 | Blue 15:3 | | | | | | | | |
| Comp. Ex. 4 | Polyester resin R-1 | C.I. Pigment Blue 15:3 | Paraffin | 85 | 193 | 3.5 | 7.3 | 153 | 59 | 2.5 |
| Comp. Ex. 5 | Polyester resin R-1 | C.I. Pigment Blue 15:3 | Paraffin | 85 | 193 | 3.5 | 7.0 | 110 | 0.5 | 2.5 |

| | Offset temperature (° C.) (Evaluation) | Fixing strength (cover printing method) | OHP film transmittance (%) | Heat storability index (%) (Evaluation) | Image after 30,000 copies | Image at high temperature and high humidity |
|---|---|---|---|---|---|---|
| Ex. 2 | 190 (O) | No problem | 90 | 4.9 (O) | Good | Good |
| Ex. 3 | 195 (O) | No problem | 88 | 3.9 (O) | Good | Good |
| Ex. 4 | 195 (O) | No problem | 89 | 3.0 (O) | Good | Good |
| Ex. 5 | 200 (O) | No problem | 87 | 4.5 (O) | Good | Good |
| Ex. 6 | 195 (O) | No problem | 91 | 4.3 (O) | Good | Good |
| Ex. 7 | 200 (O) | No problem | 90 | 4.5 (O) | Good | Good |
| Ex. 8 | 180 (O) | No problem | 81 | 3.3 (O) | Good | Good |
| Comp. Ex. 1 | 145 (X) | No problem | 77 | 8.4 (Δ) | Slightly deteriorated | Good |
| Comp. Ex. 2 | 190 (O) | No problem | 79 | 19 (X) | Deteriorated | Deteriorated |
| Comp. Ex. 3 | 190 (O) | No problem | 79 | 16 (X) | Deteriorated | Deteriorated |
| Comp. Ex. 4 | 190 (O) | No problem | 79 | 25 (X) | Deteriorated | Deteriorated |
| Comp. Ex. 5 | 145 (X) | No problem | 78 | 3.1 (O) | Low density | Low density |

Evaluation criteria:
Offset temperature: X lower than 150° C.; Δ 150° C. or higher and less than 180° C.; O 180° C. or higher
Heat blocking index O less than 6%; Δ 6% or more and less than 10%; X 10% or more As is clear from the above examples and comparative examples, the toners of the present invention have sufficient oilless fixing capability and high resistance to fusion-adhesion and to filming of the toners. Also, toner particles can be transferred from the photosensitive member and from the intermediate transfer member at a high transfer efficiency, whereby clear full-color images can be obtained. Also, it was confirmed that the toner of the present invention was useful in preparing a color OHP film which was excellent in transparency. Further, as is clear from Example 9, a clear full-color image can be obtained even if the developing system is changed.

Example 10

(A) Preparation of wax dispersion

A pigment dispersion was prepared according to the following sequence:

30 parts of paraffin wax (melting point: 89° C.) and 250 parts of ethyl acetate were thermally melted and the mixture was placed in a pressure vessel. The pressure inside the vessel was raised to 700 kg/cm$^2$ and then the mixture was ejected from the vessel to prepare a wax dispersion in ethyl acetate. The average dispersion diameter of the wax which was measured using a laser diffraction/scattering size distribution measuring apparatus (LA-700, manufactured by Horiba Seisakusho Ltd.) was 0.7 μm and the ratio of the number of wax particles having an average particle diameter of 5 μm or more was 0.5%. The shape of the wax in the wax dispersion was observed using a scanning electron microscope (SEM), 90% of the wax particles were flake-shaped. The average thickness was 0.3 μm, the average longitudinal length was 0.9 μm, and the average transverse length was 0.6 μm. Particles of a size of 5 μm or more were not observed. These values were calculated from the averages of 20 wax particles in the SEM photograph.

(B) Preparation of oil-phase 100 parts of polyester resin (Tg: 64° C., Tm: 102° C., weight-average molecular weight: 9,000) including a bisphenol A propylene oxide adduct, a bisphenol A ethylene oxide adduct, and a succinic acid derivative, 4 parts of C. I. Pigment Blue 15:3, and 80 parts by weight of ethyl acetate were dispersed for 10 hours by use of a ball mill and then 36 parts by weight of the wax dispersion in ethyl acetate was added to the mixture. The resulting mixture was agitated until these were homogeneously mixed sufficiently to prepare an oil-phase component.

(C) Preparation of water-phase 60 parts by weight of calcium carbonate and 40 parts by weight of water were dispersed using a ball mill for 10 hours to prepare a calcium carbonate dispersion. 7 parts by weight of the calcium carbonate dispersion and 100 parts by weight of 2% solution of Celogen BS/H (manufactured by Dai-ichi Kogyo Seiyaku Co., Ltd.) were placed in a cooking mixer (MX-915C, manufactured by Matsushita Electric Industrial Co., Ltd.) and mixed for 5 minutes to prepare a water-phase component.

(D) Process for manufacturing toner 100 parts by weight of the above oil-phase component was added to the water-phase component and mixed using the cooking mixer for 6 minutes. Then, the mixture was heated at 40° C. in a water bath to distill away the solvent. 100 parts by weight of 6N hydrochloric acid was added to the mixture to remove calcium carbonate, then the mixture was washed with water and dried to prepare a solid toner of an average particle diameter of 7.1 μm. The shape of the toner which was detected using a SEM photograph was spherical. In order to confirm the shape of wax inside the toner, the toner was dissolved in toluene and filtered. The shape of the insoluble residue after filtration was observed with an SEM photograph the same as in the measurement of wax in the dispersion. As a result, 85% of the residue was flake-shaped. The average thickness was 0.41 μm, the average longitudinal length was 1.0 μm, and the average transverse length was 0.7 μm. A photograph of the toner in cross-section observed using a transmission electron microscope (TEM) indicated that wax largely distributed inside the toner and the ratio of wax disposed on the surface of the toner was 4%. Also, the content of wax inside the toner was 3.1% by weight.

(E) Preparation of a developer and evaluation by actual machine 1 part by weight of silica R972 (Nippon Aerosil Co., Ltd.) was added to 100 parts by weight of the toner and the mixture was mixed using a sample mill for one minute to prepare a silica-added toner. An image was formed by use of the silica-added toner without using fixing fuser oil by A-color 935 (manufactured by Fuji Xerox Co., Ltd.) and the image was evaluated. Results of the evaluation are shown in Table 5. As described below for the evaluation method, the image quality was visually inspected to evaluate color tones, image density, fog, and fixing capability to paper and OHP film at the initial stage and after 1,000 copies. The offset was evaluated by visually inspecting the toner adhering to the fixing roller at the initial stage and after 1,000 copies. The light transmittance of an OHP film was evaluated by measuring the transmittance of light which was not absorbed by colorants after fixing a solid image. The size of wax inside the toner was calculated from the average of diameters in a horizontal direction of 10 samples randomly selected from the TEM photograph of toner in cross-section. The storability was F, evaluated by visually inspecting for the occurrence of aggregation of the toner after the toner was allowed to stand at 50° C. for 3 hours. The transfer property was evaluated by visually inspecting toner remaining on the surface of the photosensitive member immediately after an image was transferred to paper.

Examples 11

30 parts of microcrystalline wax (melting point: 84° C.) was heated and dissolved in 250 parts of ethyl acetate and a pressure of 500 kg/cm$^2$ was applied to the mixture in a pressure vessel. Thereafter, the mixture was ejected from the vessel to prepare a wax dispersion in ethyl acetate. The average diameter of the wax dispersion which was measured using a laser diffraction/scattering size distribution measuring apparatus (LA-700, manufactured by Horiba Seisakusho Ltd.) was 0.9 μm and the ratio of the number of the wax particles having an average particle diameter of 5 μm or more was 1.2%. The shape of wax in the wax dispersion was observed using a scanning electron microscope (SEM). As a result, 85% of wax particles were flake-shaped. The average thickness was 0.3 μm, the average longitudinal length was 1.0 μm, and the average transverse length was 0.5 μm. The proportion of the number of wax particles of a size of 5 μm or more was 5%.

100 parts of polyester resin (Tg: 64° C., Tm: 102° C., weight-average molecular weight: 9,000) including bisphenol A propylene oxide adduct, bisphenol A ethylene oxide adduct, and succinic acid derivative, 3 parts of C. I. Pigment Red 57, and 100 parts by weight of ethyl acetate were dispersed for 5 hours by use of a sand mill and then 36 parts by weight of the wax-ethyl acetate dispersion was added to the mixture. The resulting mixture was agitated until these were homogeneously mixed sufficiently to prepare an oil-phase component.

60 parts by weight of calcium carbonate and 40 parts by weight of water were dispersed using a ball mill for 10 hours to prepare a calcium carbonate dispersion. 6 parts by weight of the calcium carbonate dispersion and 100 parts by weight of 2% solution of Celogen BS/H (manufactured by Dai-ichi Kogyo Seiyaku Co., Ltd.) were placed in a cooking mixer (MX-915C, manufactured by Matsushita Electric Industrial Co., Ltd.) and mixed for 5 minutes to prepare a water-phase component. To the water-phase component was added 50 parts by weight of the above oil-phase component and mixed using the cooking mixer for 6 minutes. Then, the mixture was heated at 70° C. in a water bath to distill away the solvent. 100 parts by weight of 6N hydrochloric acid was added to the mixture to remove calcium carbonate, then the mixture was washed with water and dried to prepare a solid toner having an average particle diameter of 6.1 μm. The shape of the toner which was detected using an SEM photograph was spherical. In order to confirm the shape of wax in the toner, the SEM photograph was observed. As a result, 85% of the wax was flake-shaped. The average thickness was 0.3 μm, the average longitudinal length was 1.0 μm, and the average transverse length was 0.7 μm. A photograph of the toner in cross-section observed using a transmission electron microscope (TEM) indicated that wax largely distributed inside the toner and the ratio of wax disposed on the surface of the toner was 5%. Also, the content of wax inside the toner was 3.0% by weight.

1 part by weight of silica R972 (Nippon Aerosil Co., Ltd.) was added to 100 parts by weight of the toner and the mixture was mixed using a sample mill for one minute to prepare a silica-added toner. This silica-added toner was evaluated in the same manner as in Example 10 using an A-color 935 (manufactured by Fuji Xerox Co., Ltd.) without fixing fuser oil. Results of the evaluation are shown in Table 5.

Examples 12

30 parts of Fisher-Tropsch wax (melting point: 98° C.) was heated and dissolved in 250 parts of toluene and a pressure of 700 kg/cm$^2$ was applied to the mixture in a pressure vessel. Thereafter, the mixture was ejected from the vessel to prepare a wax dispersion in toluene. The average diameter of the wax dispersion was 0.8 μm and the ratio of the number of the wax particles having an average particle diameter of 5 μm or more was 2% (measured using a laser diffraction/scattering size distribution measuring apparatus (LA-700, manufactured by Horiba Seisakusho Ltd.)) The shape of wax in the wax dispersion was observed using a scanning electron microscope (SEM). As a result, 90% of the wax particles were flake-shaped. The average thickness was 0.3 μm, the average longitudinal length was 0.9 μm, and the average transverse length was 0.6 μm. The proportion of a number of wax particles of a size of 5 μm or more was 5%.

100 parts of styrene-n-butyl acrylate copolymer resin (80:20, weight-average molecular weight: 200,000), 6 parts of C.I. Pigment Yellow 17, and 1000 parts by weight of toluene were dispersed for 5 hours by a sand mill and then 72 parts by weight of the wax-toluene dispersion was added to the mixture. The resulting mixture was agitated until homogeneously mixed sufficiently to prepare an oil-phase component.

60 parts by weight of calcium carbonate and 40 parts by weight of water were dispersed for 10 hours using a ball mill to prepare a calcium carbonate dispersion. 6 parts by weight of the calcium carbonate dispersion and 100 parts by weight of 2% solution of Celogen BS/H (manufactured by Dai-ichi Kogyo Seiyaku Co., Ltd.) were placed in a desk colloid mill(Nippon Seiki Seisakusho) and mixed at 5,000 rpm for 5 minutes to prepare a water-phase component. To the water-phase component was added 50 parts by weight of the above oil-phase component and mixed at 8,000 rpm for 20 minutes. Then, the solvent was removed from the mixture at 25° C. in a water bath under reduced pressure. 100 parts by weight of 6N hydrochloric acid was added to the mixture to remove calcium carbonate, then the mixture was washed with water and dried to prepare a solid toner with an average particle diameter of 7.4 μm. The shape of the toner which was observed from an SEM photograph was spherical. The shape of wax in the wax dispersion was observed from the SEM photograph. As a result, 85% of the particles was flake-shaped. The average thickness was 0.3 μm, the average longitudinal length was 1.0 μm, and the average transverse length was 0.6 μm. The ratio of the number of particles having a size of 5 μm or more is 5%. A photograph of the toner in cross section observed using a transmission electron microscope (TEM) indicated that wax largely distributed inside the toner and the ratio of wax disposed on the surface of the toner was 3%. Also, the content of wax inside the toner was 3.0% by weight.

1 part by weight of silica R972 (Nippon Aerosil Co., Ltd.) was added to 100 parts by weight of the toner and the mixture was mixed using a sample mill for one minute to prepare a silica-added toner. This silica-added toner was evaluated in the same manner as in Example 10 using an A-color 935 (manufactured by Fuji Xerox Co., Ltd.) without fixing fuser oil. Results of the evaluation are shown in Table 5.

Examples 13

30 parts of paraffin wax (melting point 89° C.) was heated and dissolved in 250 parts of ethyl acetate and a pressure of 700 kg/cm$^2$ was applied to the mixture in a pressure vessel. Thereafter, the mixture was ejected from the vessel to prepare a wax dispersion in ethyl acetate. The average diameter of the wax dispersion was 0.8 μm and the ratio of the number of wax particles having an average particle diameter of 5 μm or more was 2% (measured using a laser diffraction/scattering size distribution measuring apparatus (LA-700, manufactured by Horiba Seisakusho Ltd.)). The shape of wax particles in the wax dispersion was observed using a scanning electron microscope (SEM). As a result, 90% of the wax particles were flake-shaped. The average thickness was 0.3 μm, the average longitudinal length was 0.9 μm, and the average transverse length was 0.6 μm. The proportion of the number of wax particles having a size of 5 μm or more was 5%.

100 parts of styrene-n-butyl acrylate copolymer resin (80:20, weight-average molecular weight: 200,000), 5 parts by weight of carbon black, and 1,000 parts by weight of ethyl acetate were dispersed for 5 hours and then 42 parts by weight of the wax-ethyl acetate dispersion was added to the mixture. The resulting mixture was agitated until homogeneously mixed sufficiently to prepare an oil-phase component.

60 parts by weight of calcium carbonate and 40 parts by weight of water were dispersed using a ball mill for 10 hours to prepare a calcium carbonate dispersion. 6 parts by weight of the calcium carbonate dispersion and 100 parts by weight of 2% solution of Celogen BS/H (manufactured by Dai-ichi Kogyo Seiyaku Co., Ltd.) were placed in a desk colloid mill (manufactured by Nippon Seiki Seisakusho Ltd.) and mixed at 5,000 rpm for 5 minutes to prepare a water-phase component. To the water-phase component was added 50 parts by weight of the above oil-phase component and mixed at 8,000 rpm for 20 minutes. Then, the solvent was distilled away under a reduced pressure at 25° C. in a water bath. 100 parts by weight of 6N hydrochloric acid was added to the mixture to remove calcium carbonate, then the mixture was washed with water and dried to prepare a solid toner of an average particle diameter of 7.4 μm. The shape of the toner observed from an SEM photograph was spherical. Also, the shape of wax in the wax dispersion was observed from the SEM photograph. As a result, 89% of the wax was flake-shaped. The average thickness was 0.3 μm, the average longitudinal length was 1.0 μm, and the average transverse length was 0.6 μm. The proportion of the number of wax particles having a size of 5 μm or more was 5%. A photograph of the toner in section observed using a transmission electron microscope (TEM) indicated that wax largely distributed inside the toner and the ratio of wax disposed on the surface of the toner was 7%. Also, the content of wax inside the toner was 3.3% by weight.

1 part by weight of silica R972 (Nippon Aerosil Co., Ltd.) was added to 100 parts by weight of the toner and the mixture was mixed using a sample mill for one minute to prepare a silica-added toner. This silica-added toner was evaluated the same as in Example 10 using A-color 935 (manufactured by Fuji Xerox Co., Ltd.) without fixing fuser oil. Results of the evaluation are shown in Table 5.

Comparative Example 6

100 parts of styrene-n-butyl acrylate copolymer resin, (80:20, weight-average molecular weight: 200,000), 3 parts by weight of C.I. Pigment Red 57, and 3 parts of paraffin wax (melting point: 89° C.) were mixed. The mixture was kneaded and pulverized using a kneader and classified to prepare a solid toner having an average particle size of 7.8 μm. The shape of 95% of the wax observed from an SEM photograph was spherical. The average particle diameter of the wax particles was 0.9 μm and particles of a size of 5 μm or more were not observed. A photograph of the toner in cross-section observed using a transmission electron microscope (TEM) indicated that part of the wax was distributed to the surface of the toner. The content of wax on the surface calculated by ESCA was 32%. Also, the content of wax inside the toner was 2.8% by weight.

1 part by weight of silica R972 (Nippon Aerosil Co., Ltd.) was added to 100 parts by weight of the toner and the mixture was mixed using a sample mill for one minute to prepare a silica-added toner. This silica-added toner was evaluated in the same manner as in Example 10 lousing A-color 935 (manufactured by Fuji Xerox Co., Ltd.) without fixing fuser oil. Results of the evaluation are shown in Table 5.

Comparative Example 7

A solid toner having an average particle diameter of 8.1 μm was prepared in the same manner as in comparative Example 6 except that the amount of wax in comparative Example 6 was changed from 3 parts by weight to 15 parts by weight. The shape of 90% of the toner observed from an SEM photograph was spherical. The average particle diameter of the toner was 1.0 μm and particles of a size of 5 μm or more was not observed. A photograph of the toner in section observed using a transmission electron microscope (TEM) indicated that part of the wax was disposed on the surface of the toner. The content of wax on the surface calculated by ESCA was 46%. Also, the content of wax inside the toner was 12.5% by weight.

1 part by weight of silica R972 (Nippon Aerosil Co., Ltd.) was added to 100 parts by weight of the toner and the mixture was mixed using a sample mill for one minute to prepare a silica-added toner. This silica-added toner was evaluated in the same manner as in Example 10 using A-color 935 (manufactured by Fuji Xerox Co., Ltd.) without fixing fuser oil. Results of the evaluation are shown in Table 5.

TABLE 5

| | Image quality | | Offset | | OHP light | | | Amount of |
|---|---|---|---|---|---|---|---|---|
| | Initial stage | After 1,000 copies | Initial stage | After 1,000 copies | transmittance (%) | Storability | Transfer efficiency | wax on surface (%) |
| Ex. 10 | Good | Good | None | None | 92 | Good | Good | 4 |
| Ex. 11 | Good | Good | None | None | 90 | Good | Good | 5 |
| Ex. 12 | Good | Good | None | None | 89 | Good | Good | 3 |
| Ex. 13 | Good | Good | None | None | 93 | Good | Good | 7 |
| Comp. Ex. 6 | Good | Poor | None | Observed | 90 | Slightly aggregated | Slightly poor | 32 |
| Comp. Ex. 7 | Good | Poor | None | Observed | 80 | Slightly aggregated | Slightly poor | 46 |
| Comp. Ex. 8 | Good | Poor | None | Observed | 88 | Good | Good | 4 |

As is clear from these examples and comparative examples, the toner of the present invention in which flake-shaped wax is dispersed is excellent both in storability and transfer capability. In contrast, the toner of the comparative examples has the drawback that a reduction in image quality was observed after 1,000 copies.

The toner of the present invention for developing an electrostatic latent image and the developer containing the toner of the present invention for an electrostatic latent image are characterized in that it is not necessary to supply oil to a fixing system and that the oilless fixing capability, powder characteristics of the toner using wax, filming characteristics, and high transfer capability required for forming a color image can be satisfied compatibly. These characteristics are advantageous in designing inexpensive copy machines and printers. A novel toner having excellent characteristics can be produced simply by the process of the present invention for manufacturing toner. Also, with the method of the present invention for forming an image, a high-quality image and an excellent OHP film transmitting image can be formed.

What is claimed is:

1. A toner, for developing an electrostatic latent image, comprising a binding resin, a colorant, and a wax, wherein:

said toner contains from 0.1% to 40% by weight of said wax;

1% to 10% by weight of said wax is disposed on a surface of said toner; and a number-average dispersion diameter of said wax is from 0.1 to 2 μm.

2. A toner for developing an electrostatic latent image according to claim 1, wherein said wax comprises flake-shaped particles.

3. A toner for developing an electrostatic latent image according to claim 2, wherein said wax includes wax particles of which 75% or more are flaked-shaped particles, wherein each of said flake-shaped particles has a thickness of 0.5 μm or less, a maximum longitudinal length 2 or more times the thickness, and a maximum transverse length of 1.5 or more times the thickness.

4. A toner for developing an electrostatic latent image according to claim 2, wherein 10% or less of said flake-shaped particles have a longitudinal length of 5 μm or more, and an average longitudinal length of said flake-shaped particles is 1 μm or less.

5. A toner for developing an electrostatic latent image according to claim 1, wherein a melting point of said wax is 110° C. or less.

6. A toner for developing an electrostatic latent image according to claim 1, wherein a latent heat for melting said wax is 230 mJ/mg or less.

7. A toner for developing an electrostatic latent image according to claim 1, wherein said wax is a compound selected from the group consisting of petroleum wax and synthetic wax.

8. A toner for developing an electrostatic latent image according to claim 1, wherein a shape factor MLS2 of a particle of said toner is in a range of from 100 to 140.

9. A two-component developer for an electrostatic latent image comprising a carrier and a toner, wherein, said toner contains from 0.1% to 40% by weight of wax;

1% to 10% by weight of said wax is disposed on a surface of said toner; and a number-average dispersion diameter of said wax is from 0.1 to 2 μm.

10. A developer for an electrostatic latent image according to claim 9, wherein a melting point of said wax is 110° C. or less.

11. A developer for an electrostatic latent image according to claim 9, wherein said wax comprises flake-shaped particles.

12. A process for manufacturing a toner for developing an electrostatic latent image, wherein the toner includes at least a resin, a colorant, and a wax, comprising the steps of:

dissolving or dispersing the resin, colorant, and wax into an organic solvent to form an oil-phase component; and granulating the oil-phase component in an aqueous solvent, wherein 1% to 10% of said wax is disposed on a surface of said toner; and a number-average dispersion diameter of said wax is from 0.1 to 2 μm.

13. A process for manufacturing a toner for developing an electrostatic latent image, wherein the toner includes at least a resin, a colorant, and a wax, comprising the steps of, dissolving or dispersing each of the colorant and wax into monomers of the resin to form an oil-phase component;

granulating the oil-phase component in an aqueous solvent to form particles; and suspension-polymerizing the particles prepared in the granulation step, wherein 1% to 10% by weight of said wax is disposed on a surface of said toner; and a number-average dispersion diameter of said wax is from 0.1 to 2 $\mu$m.

14. A process for manufacturing a toner for developing an electrostatic latent image according to claim 12, wherein said step of dissolving or dispersing further comprises pulverizing the wax in the organic solvent.

15. A process for manufacturing a toner for developing an electrostatic latent image according to claim 12, wherein said step of dissolving or dispersing further comprises dissolving or dispersing the wax in an organic solvent; and cooling the organic solvent to precipitate the wax, thereby preparing fine wax particles.

16. A process for manufacturing a toner for developing an electrostatic latent image according to claim 12, wherein said step of dissolving or dispersing further comprises evaporating the wax in a vapor phase; and solidifying the wax to prepare fine wax particles.

17. A process for manufacturing a toner for developing an electrostatic latent image according to claim 12, wherein at least one of an inorganic dispersion stabilizer and an organic dispersion stabilizer containing a hydrophilic colloid is added to said aqueous solvent.

18. A process for manufacturing a toner for developing an electrostatic latent image according to claim 12, further comprising:

an acid washing step of adding an acid to allow a dispersion stabilizer remaining on the surface of the toner to become water-soluble to remove the dispersion stabilizer from the surface of the toner.

19. A process for manufacturing a toner for developing an electrostatic latent image according to claim 12, further comprising:

an alkali washing step of adding an alkali to remove wax remaining on the surface of the toner.

20. An image-forming method comprising steps of forming a latent image on an image-bearing substrate, developing the latent image using a toner, and transferring a formed toner image to a transfer member, wherein, said toner includes a binding resin, a colorant, and a wax;

said toner contains from 0.1% to 40% by weight of said wax;

1% to 10% by weight of said wax is disposed on a surface of said toner; and a number-average dispersion diameter of said wax is from 0.1 to 2 $\mu$m.

* * * * *